US012410793B2

(12) United States Patent
Chang

(10) Patent No.: US 12,410,793 B2
(45) Date of Patent: Sep. 9, 2025

(54) PUMP WITH VARIABLE SUCTION/DISCHARGE AMOUNT AND DRIVE DEVICE COMPOSED OF THE PUMP AND DRIVING METHOD THEREOF

(71) Applicant: Jui-Cheng Chang, Keelung (TW)

(72) Inventor: Jui-Cheng Chang, Keelung (TW)

(73) Assignee: CH Creative Co., Ltd., Taipei (TW)

( * ) Notice: Subject to any disclaimer, the term of this patent is extended or adjusted under 35 U.S.C. 154(b) by 0 days.

(21) Appl. No.: 17/906,703

(22) PCT Filed: Mar. 20, 2020

(86) PCT No.: PCT/CN2020/080389

§ 371 (c)(1),
(2) Date: Sep. 19, 2022

(87) PCT Pub. No.: WO2021/184344

PCT Pub. Date: Sep. 23, 2021

(65) Prior Publication Data

US 2023/0136689 A1 May 4, 2023

(51) Int. Cl.

| | |
|---|---|
| ***F04C 2/344*** | (2006.01) |
| ***F04C 14/04*** | (2006.01) |
| ***F04C 14/18*** | (2006.01) |
| ***F04C 28/04*** | (2006.01) |
| ***F04C 28/18*** | (2006.01) |

(52) U.S. Cl.

CPC ..... *F04C 2/344* (2013.01); *F04C 2/3441* (2013.01); *F04C 2/3442* (2013.01); *F04C 14/04* (2013.01); *F04C 14/18* (2013.01); *F04C 14/185* (2013.01); *F04C 28/04* (2013.01); *F04C 28/18* (2013.01); *F04C 28/185* (2013.01)

(58) Field of Classification Search

CPC ..... F04C 14/18; F04C 14/185; F04C 14/04; F04C 28/18; F04C 28/185; F04C 28/04; F04C 2/344; F04C 2/3441; F04C 2/3442

See application file for complete search history.

(56) References Cited

U.S. PATENT DOCUMENTS 1,527,685 A * 2/1925 Huwiler ..... F04C 2/3446 418/28

1,565,696 A * 12/1925 Whitehead ..... F04C 2/344 418/98

(Continued)

*Primary Examiner* — Christopher S Bobish

(74) *Attorney, Agent, or Firm* — Rosenberg, Klein & Lee

(57) ABSTRACT

A pump with variable suction/discharge amount and a transmission drive device and a driving method thereof. The pump is a rotary vane pump having a vane chamber body. The vane chamber body is composed of a fixed wall member, a movable wall member, a movable vane chamber sleeve and a vane rotor. The vane chamber is extendable/retractable in an axial direction of the vane rotor. At least two pumps are assembled in communication with each other to form a closed loop for the active pump to drive the passive pump. In operation, passive the vane chambers of the active pump and the passive pump are automatically extended/retracted and modulated until the driving force and the load resistance achieve a balanced state passive, the vane chambers and the rotational speeds of the active pump and the passive pump are automatically adjusted to be in inverse proportion to each other.

14 Claims, 21 Drawing Sheets

(56) References Cited

U.S. PATENT DOCUMENTS 1,719,135 A * 7/1929 Roessler ..... F01C 1/344 418/189
1,797,905 A * 3/1931 Dooley ..... F04C 14/185 418/28
2,015,307 A * 9/1935 Hand ..... F04C 2/356 418/256
2,330,565 A * 9/1943 Eckart ..... F04C 14/185 418/28
2,581,160 A * 1/1952 Adams ..... F04C 2/3448 418/28
3,111,905 A * 11/1963 Eickmann ..... F04C 2/348 418/83
3,588,295 A * 6/1971 Na ..... F04C 14/18 418/21
3,687,578 A * 8/1972 White, Jr. ..... F04C 14/18 418/61.3
4,046,493 A * 9/1977 Alund ..... F01C 1/3448 417/220
4,545,204 A * 10/1985 Whalen ..... F16H 39/28 418/28
4,551,080 A * 11/1985 Geiger ..... F04C 14/185 418/28
4,758,137 A * 7/1988 Kieper ..... F04C 14/185 418/28
5,135,372 A * 8/1992 Pipalov ..... F01C 1/34 418/173
5,399,077 A * 3/1995 Renger ..... F04C 14/185 418/24
5,660,537 A * 8/1997 Thompson ..... F04C 14/185 418/28
5,674,059 A * 10/1997 Bucur ..... F04C 14/185 418/28
7,793,683 B2 * 9/2010 Noble ..... F04C 2/1071 137/853
8,651,825 B2 * 2/2014 Williamson ..... F04C 14/226 417/220
9,482,228 B2 * 11/2016 Fujita ..... F04C 18/344
2018/0372094 A1 * 12/2018 Godinho Completo ..... F04C 2/3448

* cited by examiner

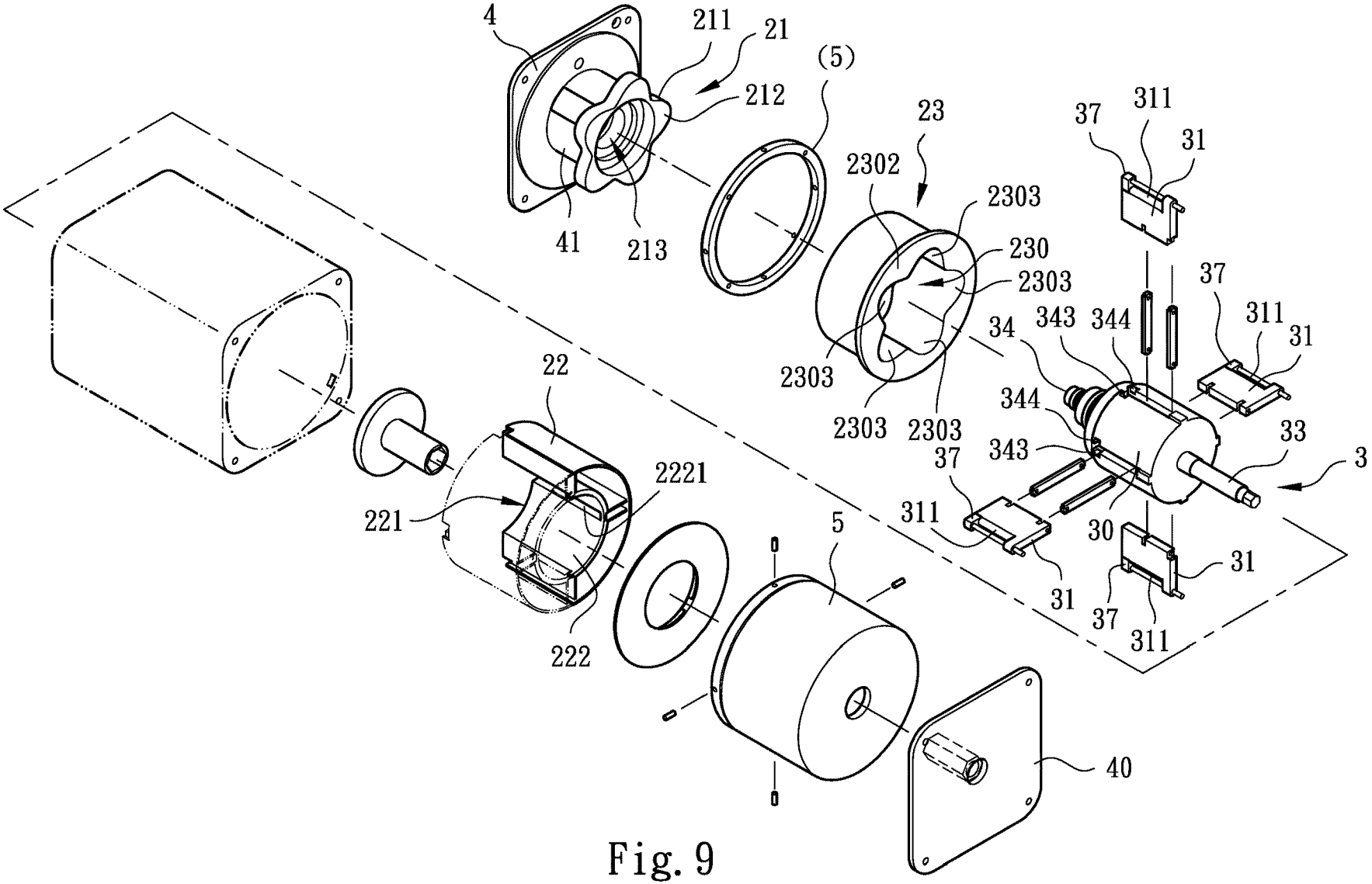
3
33
31
311
37
344
343
34
30
40
5
2221
222
22
221
4
41
213
211
21
212
(5)
23
2302
2303
230
2303
2303
2303

PUMP WITH VARIABLE SUCTION/DISCHARGE AMOUNT AND DRIVE DEVICE COMPOSED OF THE PUMP AND DRIVING METHOD THEREOF

BACKGROUND OF THE INVENTION

1. Field of the Invention

The present invention relates generally to a pump with variable suction/discharge amount and a drive device composed of the pump and a driving method thereof, and more particularly to a rotary vane pump composed of a fixed wall member, a movable wall member, a movable vane chamber sleeve and a vane rotor. The rotary vane pump has a vane chamber, which is extendable/retractable in an axial direction of the vane rotor. Accordingly, the capacity of the vane chamber is variable to form the pump with variable suction/discharge amount. In addition, at least two pumps with variable suction/discharge amount can be assembled in communication with each other to form an active/passive drive device. Moreover, in the principle that the driving force and the load resistance must be balanced, during the operation process, the drive device can automatically adjust the rotational speed ratio between the active pump and the passive pump as a transmission drive device.

2. Description of the Related Art

The conventional pumps can be generally classified into two major types, that is, the pump with constant suction/discharge amount and the pump with variable suction/discharge amount. The pump with variable suction/discharge amount has wider application range and thus is popularly employed in relevant industries. With respect to the structural form, the pump with variable suction/discharge amount can be further classified into two types, that is, piston-type pump with variable suction/discharge amount and rotary vane pump with variable suction/discharge amount. The piston-type pump with variable suction/discharge amount generally has a rotary swash plate with variable angle. In rotation, the swash plate sequentially pushes multiple piston-type cylinder blocks arranged substantially in parallel to each other. FIG. 1 shows a conventional rotary vane pump with variable suction/discharge amount. The rotary vane pump mainly includes a vane rotor 10 disposed in a cam ring 11 inside the pump 1. An eccentric amount adjustment member 12 is disposed on one side of the cam ring 11 to push the cam ring 11 and adjust the eccentric amount of the eccentric amount adjustment member 12 to the vane rotor 10. The eccentric amount is adjustable so that the fluid receiving space between the vane rotor 10 and the cam ring 11 can be modulated so as to vary the suction/discharge amount of the pump.

However, the cam ring 11 is mounted in the pump 1 so that the adjustable displacement amount is limited within the fixed space of the housing of the pump. The size of the internal space of the housing directly affects and restricts the radial sizes of the pump body and all the components. As a result, when it is necessary to manufacture different products with maximal suction/discharge amount, the commonality of the components of the different pumps with different suction/discharge amounts is quite low. Therefore, it is necessary redesign numerous components of each new pump with maximal suction/discharge amount and manufacture the molds for molding the components. As a result, the manufacturing cost is greatly increased. In addition, in operation, in case the distance between the suction side and the discharge side of the pump is relatively long, then the pressure difference between the suction side and the discharge side will be excessively great. Under such circumstance, the reciprocal radial extension/retraction displacement amount of the respective vanes may be too large. This will lead to ill affection of vibration or collision noise.

SUMMARY OF THE INVENTION

It is therefore a primary object of the present invention to provide a novel rotary vane pump with variable suction/discharge amount to solve the above problems existing in the conventional pump with variable suction/discharge amount. The vane chamber of the pump is extendable/retractable in an axial direction of the vane rotor to modulate the capacity of the vane chamber. Accordingly, the unit circulation suction/discharge amount of the fluid in the pump can be increased/decreased with the axial change of the space of the vane chamber. Therefore, when it is necessary to manufacture different pumps with different suction/discharge amounts, the radial specifications of the respective components are in conformity with each other so that the community in use of the components is enhanced and the manufacturing and material costs of different pumps with suction/discharge amounts are greatly lowered. Moreover, when the requirement for the maximal suction/discharge amount of the pump is increase, it is only necessary to modify the axial size of the pump and the relevant components without enlarging the radial size of the vane chamber to increase the pressure difference between the suction side and the discharge side in the vane chamber. Also, the radial extending/retracting travel of the vane will not be elongated due to the increase of the radial size of the vane chamber. Therefore, in operation, the noise made by the reciprocal extension/retraction of the vane can be effectively lowered.

It is a further object of the present invention to provide a transmission drive device composed of at least two pumps with variable suction/discharge amount. The two pumps are oppositely arranged. The fluid suction passage of one of the two pumps is in communication with the fluid discharge passage of the other of the two pumps to form a closed driving loop for the active pump to drive the passive pump. During the driving operation process of the loop, when a difference value exists between the driving force of the active pump and the load resistance of the passive pump, the difference value pushes and acts on the extendable/retractable vane chamber of the vane chamber body, whereby the capacity of the vane chamber of the active pump and the capacity of the vane chamber of the passive pump are automatically extended/retracted and modulated until the driving force applied to the fluid in the active pump and the load resistance pushed by the fluid in the passive pump are balanced. Also, in the condition that the fluid suction/discharge amount per unit time of the active pump and the fluid suction/discharge amount per unit time of the passive pump are nearly equal to each other, the capacities of the vane chambers and the rotational speeds of the active pump and the passive pump are automatically adjusted to be in inverse proportion to each other so as to balance the operation. Therefore, when the driving force or the load resistance changes, the rotational speed ratio of the active pump and the passive pump is automatically adjusted according to the change of the driving force and the load resistance so as to achieve the object of smooth transmission driving.

To achieve the above and other objects, the pump with variable suction/discharge amount of the present invention includes a vane chamber body and a vane rotor disposed in the vane chamber body. The vane chamber body is at least composed of a fixed wall member, a movable wall member and a movable vane chamber sleeve, which define a vane chamber. The vane rotor has an impeller disposed in the vane chamber. At least one vane is disposed on the impeller. The movable wall member and the movable vane chamber sleeve are displaceable in an axial direction of the vane rotor relative to the fixed wall member, whereby the vane chamber is extendable/retractable in the axial direction of the vane rotor to increase/decrease the capacity of the vane chamber.

In the above pump with variable suction/discharge amount, the number of the vanes is less than or equal to the number of the eccentric vane chamber sections.

In the above pump with variable suction/discharge amount, one single vane is disposed on the impeller and the vane chamber has at least one eccentric vane chamber section.

In the above pump with variable suction/discharge amount, the vane chamber has multiple eccentric vane chamber sections and multiple vanes are disposed on the impeller in adaptation to the multiple eccentric vane chamber sections.

In the above pump with variable suction/discharge amount, two rotor shaft ends of the vane rotor are respectively disposed on two support bodies corresponding to the two rotor shaft ends. At least one of the rotor shaft ends is externally connected with a driving member for receiving power or bearing load.

In the above pump with variable suction/discharge amount, the fixed wall member has a fixed wall seat sleeve and a fixed wall end face. The fixed wall end face is disposed at one end of the fixed wall seat sleeve and normal to the axis of the vane rotor, whereby the fixed wall end face can tightly attach to an end face of the impeller of the vane rotor normal to the axial direction of the vane rotor.

In the above pump with variable suction/discharge amount, the fixed wall member is fitted on a base seat of the support body (at one end).

The base seat has a fixed wall end boss. The fixed wall end boss is fully plugged in a fixed wall hole formed at a center of the fixed wall end face, whereby a boss end face of the fixed wall end boss and the fixed wall end face together form a fixed wall face and the fixed wall face can tightly attach to an end face of the vane rotor normal to the axial direction of the vane rotor. An eccentric rotor shaft hole is formed on the fixed wall end boss. A shaft end of the vane rotor is pivotally fitted in the eccentric rotor shaft hole.

In the above pump with variable suction/discharge amount, at least two fluid suction/discharge passages are formed in the vane rotor. One end of each suction/discharge passage, which end is directed to the vane chamber, is in communication with a suction side and a discharge side of the vane of the vane rotor. One end of each suction/discharge passage, which end is distal from the suction side and the discharge side, is in communication with at least one of two rotor shaft ends of the vane rotor.

In the above pump with variable suction/discharge amount, a fluid suction/discharge port member is pivotally fitted on and assembled with the rotor shaft end in communication with the suction/discharge passages, whereby the rotor shaft end can pivotally rotate in the fluid suction/discharge port member, while the fluid suction/discharge port member is disposed on a support body (at one end) and keeps stationary.

In the above pump with variable suction/discharge amount, the suction/discharge passages extend to the same rotor shaft end. The suction/discharge passages respectively communicates with a central section and a non-central section of the rotor shaft end and connecting with outer side directly via a suction/discharge passage disposed on at least one of the base seat and the support body.

In the above pump with variable suction/discharge amount, the movable wall member is fitted around and assembled with the vane rotor, whereby the movable wall member can slide on an outer circumference of the impeller in the axial direction of the vane rotor, the movable vane chamber sleeve being fitted around the fixed wall member and the impeller to synchronously axially slide with the movable wall member.

In the above pump with variable suction/discharge amount, a retainer member is assembled between the movable wall member and the movable vane chamber sleeve so as to keep the movable wall member and the movable vane chamber sleeve attach to and assemble with each other, whereby the movable wall member and the movable vane chamber sleeve can synchronously slide in the axial direction of the vane rotor.

In the above pump with variable suction/discharge amount, the movable wall member has a movable wall face. The movable wall face tightly attaches to vane chamber sleeve end face of the movable vane chamber sleeve distal from the fixed wall member. A fitting hole is formed at a center of the movable wall member, which is axially slidable to fit around the impeller. An inner wall of the fitting hole is formed with a vane receiving slot corresponding to the vane of the impeller, whereby the vane can slide into the vane receiving slot.

In the above pump with variable suction/discharge amount, the vane chamber inside the movable vane chamber sleeve is defined between the movable vane chamber sleeve, the fixed wall end face of the fixed wall member, the movable wall face of the movable wall member and the vane rotor. The impeller occupying a part of the vane chamber and the remaining space of the vane chamber forms at least one eccentric vane chamber section eccentric to the axis of the vane rotor.

In the above pump with variable suction/discharge amount, the vane has a vane top edge distal from the vane rotor. The vane top edge tightly attaches to the inner wall of the vane chamber and is slidable relative to the inner wall of the vane chamber in at least one of the axial and circumferential directions of the vane rotor.

In the above pump with variable suction/discharge amount, a sealing block is disposed at inter-contacting sections of the vane, the movable wall member and the movable vane chamber sleeve to avoid any gap between the inter-contacting sections of the vane, the movable wall member and the movable vane chamber sleeve, whereby the fluid in the vane chamber is prevented from leaking.

In the above pump with variable suction/discharge amount, an operation fluid is output and input into the vane chamber in a closed loop, at least one of the movable wall member and the movable vane chamber sleeve being displaceable relative to the fixed wall member, whereby the capacity of the vane chamber is changeable and the output amount and input amount of the operation fluid pushed by the rotating vane rotor to pass the vane chamber per unit time are variable with the change of the capacity of the vane chamber, whereby the vane rotor can provide power transmission at different rotational speeds according to the change of the capacity of the vane chamber.

In the above pump with variable suction/discharge amount, in the push transfer process of the sole operation fluid, the pressure in the vane chamber is changed, the change amount of the pressure pushing and acting between the movable wall member, the movable vane chamber sleeve, the vane rotor and the fixed wall member, whereby at least the movable wall member and the fixed wall member are displaced relative to each other.

In the above pump with variable suction/discharge amount, an external forcing member applies a push force to at least one of the movable wall member and the movable vane chamber sleeve to forcedly at least make the movable wall member and the fixed wall member displace relative to each other.

In the above pump with variable suction/discharge amount, a transmission drive device composed of the above pump with variable suction/discharge amount of the present invention is composed of at least two pumps with variable suction/discharge amount. The two pumps with variable suction/discharge amount are oppositely arranged. One of the two pumps with variable suction/discharge amount is set a active pump, while the other of the two pumps with variable suction/discharge amount is set a passive pump, a driving loop being formed between the active pump and the passive pump.

In the above transmission drive device, at least one of a same-direction displacement connection member and a synchronous displacement connection member is drivingly connected between at least one of the movable wall member and the movable vane chamber sleeve of the active pump and the movable wall member and the movable vane chamber sleeve of the passive pump.

In the above transmission drive device, a displacement resistant member is additionally arranged in at least one of the increasing direction of the capacity of the vane chamber of the active pump and the decreasing direction of the capacity of the vane chamber of the passive pump.

In the above transmission drive device, each of the active pump end and the passive pump end has at least four-time vanes and a number of eccentric vane chamber sections, which number is more than or equal to the number of the vanes. The angle phase of each vane in the vane chamber corresponding to the eccentric vane chamber section is 180-degree different from the angle phase of at least another vane in the vane chamber in a complementary relationship.

In the above transmission drive device, each the four-time eccentric vane chamber sections are integrally formed in one single pump with variable suction/discharge amount.

In the above transmission drive device, each eccentric vane chamber sections are formed in each independent pump with variable suction/discharge amount.

In the above transmission drive device, the transmission drive device has at least two active pumps and a common engagement member is engaged between the two active pumps to synchronously drive the two active pumps.

In the above transmission drive device, the transmission drive device has at least two active pumps and a common engagement member is engaged around the two active pumps to synchronously drive the two active pumps.

In the above transmission drive device, the transmission drive device has at least two active pumps and at least two passive pumps. At least one of the active pumps and the passive pumps is assembled and connected in an array.

In the above transmission drive device, the transmission drive device has at least two active pumps and at least two passive pumps. At least one of the active pumps and the passive pumps is linearly assembled and connected.

In the above transmission drive device, the transmission drive device has at least two active pumps and at least two passive pumps. At least one of the active pumps and the passive pumps is serially assembled and connected in the form of a string.

In the above transmission drive device employing the pump with variable suction/discharge amount of the present invention, an operation fluid is output and input into the vane chamber in a closed loop, at least one of the movable wall member and the movable vane chamber sleeve being displaceable relative to the fixed wall member, whereby the capacity of the vane chamber is changeable and the output amount and input amount of the operation fluid pushed by the rotating vane rotor to pass the vane chamber per unit time are variable with the change of the capacity of the vane chamber, whereby the vane rotor can provide power transmission at different rotational speeds according to the change of the capacity of the vane chamber.

In the above transmission drive device, in the push transfer process of the sole operation fluid, the pressure in the vane chamber is changed, the change amount of the pressure pushing and acting between the movable wall member, the movable vane chamber sleeve, the vane rotor and the fixed wall member, whereby at least the movable wall member and the fixed wall member are displaced relative to each other.

In the above driving method, an external forcing member applies a push force to at least one of the movable wall member and the movable vane chamber sleeve to forcedly at least make the movable wall member and the fixed wall member displace relative to each other.

The driving method employing the pump with variable suction/discharge amount of the present invention includes steps of:

(1) making the transmission drive device operate and producing a difference value between the driving force of the active pump and the load resistance born by the passive pump;

(2) automatically extending/retracting and modulating the capacity of the vane chamber of the active pump and the capacity of the vane chamber of the passive pump due to the push of the difference value between the driving force and load resistance; and (3) in the condition that the fluid suction/discharge amount per unit time of the active pump and the fluid suction/discharge amount per unit time of the passive pump are nearly equal to each other, making the driving force applied to the fluid in the active pump equal to the load resistance of the fluid in the passive pump so as to achieve balanced operation and automatically adjusting the capacity of the vane chamber of the active pump and the capacity of the vane chamber of the passive pump and the rotational speeds of the active pump and the passive pump to make the active pump and the passive pump operate in inverse proportion to each other, whereby when the action between the driving force and the load resistance changes, the capacity of the vane chamber of the active pump and the capacity of the vane chamber of the passive pump and the rotational speed ratio therebetween are automatically adjusted so as to achieve balanced driving between the driving force and the load resistance in operation.

In the above driving method, in operation of the driving loop, the driving force of the active pump rotates the vane rotor to drive the vane to apply a push pressure to the movable vane chamber sleeve, the fixed wall face of the fixed wall member and the movable wall face of the movable wall member positioned on the discharge side of the vane in the eccentric vane chamber section of the active pump and the vane face of the vane, the movable vane chamber sleeve, the fixed wall face and the movable wall face positioned on the suction side of the vane in the eccentric vane chamber section of the passive pump. On the other hand, at the same time, after pushed, a vacuum sucking force is applied to the movable vane chamber sleeve, the fixed wall face and the movable wall face positioned on the suction side of the vane in the eccentric vane chamber section of the active pump and the vane face of the vane, the movable vane chamber sleeve, the fixed wall face and the movable wall face positioned on the discharge side of the vane in the eccentric vane chamber section of the passive pump. After the movable wall face bears the push pressure or the vacuum sucking force, the movable wall member and the movable vane chamber sleeve tightly attaching thereto are synchronously axially moved. Two sides of the vane in the passive pump are respectively double-affected by the push pressure and the vacuum sucking force in the same direction and passive, whereby the vane rotor is passive to rotate and output power to the load end of the passive pump.

In the above driving method, in case the area of the movable wall face of the movable wall member on the discharge side of the vane in the eccentric vane chamber section of the active pump is larger than the area of the movable wall face of the movable wall member on the suction side of the vane in the eccentric vane chamber section of the passive pump, the movable wall member and the movable vane chamber sleeve of the active pump gradually axially displace in a direction away from the fixed wall face of the fixed wall face to enlarge the axial space of the eccentric vane chamber section. At the same time, a sucking force is applied to the suction side of the vane of the passive pump, whereby the movable wall member and the movable vane chamber sleeve of the passive pump are sucked to axially displace in a direction toward the fixed wall face. Also, in case the area of the movable wall face on the suction side of the vane in the eccentric vane chamber section of the active pump is smaller than the area of the movable wall face on the discharge side of the vane in the eccentric vane chamber section of the passive pump, the vane of the active pump sweeps to produce vacuum sucking force on the suction side. A greater vacuum sucking force is applied to the movable wall face in the passive pump with larger area, whereby the movable wall member and the movable vane chamber sleeve of the active pump displace in a direction away from the fixed wall face and the movable wall member and the movable vane chamber sleeve of the passive pump displace in a direction toward the fixed wall face. Reversely, when the sizes of the areas of the movable wall faces on the discharge side and the suction side of the vanes respectively in the eccentric vane chamber sections of the active pump and the passive pump are compared with each other to be on the contrary to the above, the movable wall member and the movable vane chamber sleeve of the active pump and the passive pump displace in a direction reverse to the above direction. The same-direction displacement connection member is connected between the active pump and the passive pump so that along with the driving of the vane of the active pump. The liquid phase fluid applies a push force to the vane face on the suction side of the vane in the passive pump to gradually push the passive pump and the load end thereof so that the driving loop of the active pump and the passive pump will gradually start to operate.

In the above driving method, the active pump assembly with multiple eccentric vane chamber sections is connected with the passive pump assembly with multiple eccentric vane chamber sections. The sums of the areas of the movable wall faces respectively on two sides of the vanes in the eccentric vane chamber sections of the active pump and the passive pumps are equal to each other, whereby the driving force of the active pump assembly is balanced with the load resistance of the passive pump assembly and the sums of the areas of the movable wall faces on the discharge sides and the suction sides of the active pump assembly and the passive pump assembly are equal to each other. Also, the angle phases of the vanes respectively positioned in the eccentric vane chamber sections is arranged in a corresponding complementary relationship, whereby during any operation process, the active pump assembly and the passive pump assembly always has a vane face for bearing the power to provide driving effect.

In the above driving method, in operation of the closed driving loop of at least one of the active pump assembly and the passive pump assembly, when the driving force and the load resistance are varied, the total capacity and rotational speed of the active pump and the total capacity and rotational speed of the passive pump are automatically adjusted to make the driving force and the load resistance automatically achieve a balanced state. The rotational speed ratio of the active pump and the passive pump is automatically modulated according to the change of the driving force and the load resistance.

The present invention can be best understood through the following description and accompanying drawings, wherein:

BRIEF DESCRIPTION OF THE DRAWINGS

FIG. 4-1 is a sectional assembled view of the first preferred embodiment of the present invention according to FIG. 2, showing that the space of the vane chamber is relatively larger than the space of the vane chamber of FIG. 4;

FIG. 7-1 is a sectional assembled view of the first preferred embodiment of the present invention according to FIG. 2, showing that two active pumps are assembled with two passive pumps, wherein a same-direction displacement connection member is connected between at least one of the movable wall member and the movable vane chamber sleeve of the active pump and the passive pump;

FIG. 7-2 is a sectional assembled view of the first preferred embodiment of the present invention according to FIG. 2, showing that four active pumps are assembled with four passive pumps, wherein a synchronous displacement connection member is connected between at least one of the movable wall member and the movable vane chamber sleeve of the active pump and the passive pump;

FIG. 7-3 is a sectional assembled view of the first preferred embodiment of the present invention according to FIG. 7, wherein a displacement resistant member is additionally arranged in the increasing direction of the capacity of the vane chamber of the active pump and a same-direction displacement connection member is connected between at least one of the movable wall member and the movable vane chamber sleeve of the active pump and the passive pump;

FIG. 7-4 is a sectional assembled view of the first preferred embodiment of the present invention according to FIG. 7, wherein a displacement resistant member is additionally arranged in the decreasing direction of the capacity of the vane chamber of the passive pump and a same-direction displacement connection member is connected between at least one of the movable wall member and the movable vane chamber sleeve of the active pump and the passive pump;

FIG. 8-1 is a sectional assembled view of the first preferred embodiment of the present invention according to FIG. 2, wherein four pumps are assembled in an array to form a active pump end and a common engagement member is positioned at the center of the array and engaged with the four pumps to synchronously drive the four pumps;

FIG. 8-2 is a sectional assembled view of the first preferred embodiment of the present invention according to FIG. 2, wherein four pumps are assembled in an array to form a active pump end and a common engagement member is positioned around the array and engaged with the four pumps to synchronously drive the four pumps;

FIG. 8-3 is a sectional assembled view of the first preferred embodiment of the present invention according to FIG. 2, wherein four pumps are assembled to form a linearly arranged active pump end;

FIG. 8-4 is a sectional assembled view of the first preferred embodiment of the present invention, wherein after the forms of a shaft end and the fluid suction port member and the fluid discharge port member are changed, four pumps are serially assembled to form a stringed active pump end;

FIG. 9 is a perspective exploded view of a second preferred embodiment of the present invention;

REFERENCE NUMBERS OF DRAWINGS

Figure 1:
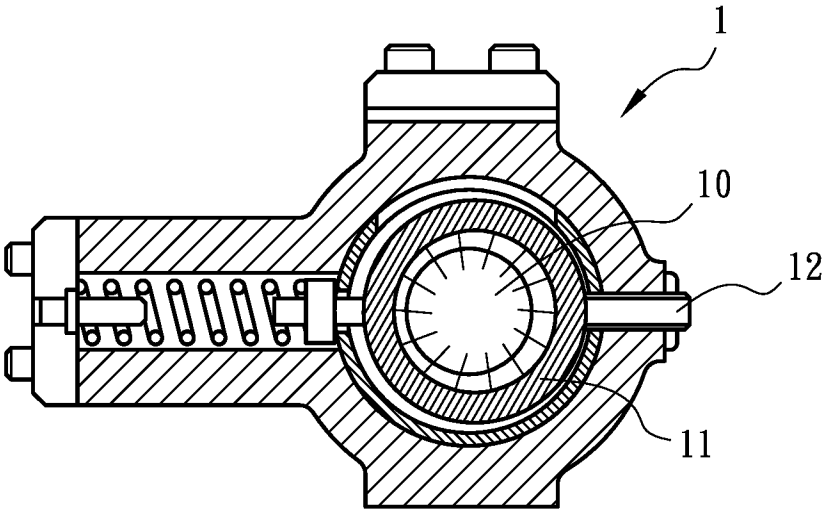
FIG. 1 is a sectional view of a conventional pump with variable suction/discharge amount, showing the structure thereof.

1 pump
10 vane rotor
101 active pump
102 passive pump
11 cam ring
12 eccentric amount adjustment member
2 vane chamber body
204 fixed wall face
21 fixed wall member
211 fixed wall seat sleeve
212 fixed wall end face
213 fixed wall hole
22 movable wall member
221 movable wall face
222 fitting hole
2221 vane receiving slot
23 movable vane chamber sleeve
230 vane chamber
2301, 2303 eccentric vane chamber section
2302 vane chamber sleeve end face
3 vane rotor
30 impeller
301 end face
31 vane
311 vane top edge
33 first rotor shaft
34 second rotor shaft
341 first suction/discharge ports
342 second suction/discharge ports
343 first suction/discharge passages
344 second suction/discharge passages
345 shaft center
346 shaft non-center
35 fluid suction/discharge port member
351 first suction/discharge passage
352 second suction/discharge passage
36 transmission member
37 sealing block
4 first support body;
40 second support body;
41 base seat
410, 4100 suction/discharge passage
411 fixed wall end boss
4110 boss end face
412 shaft hole
5 retainer member
6, 60, 61, 62 common engagement member
8 external forcing member
80 same-direction displacement connection member
800 synchronous displacement connection member
9, 90 displacement resistant member

DETAILED DESCRIPTION OF THE PREFERRED EMBODIMENTS

Figure 2:
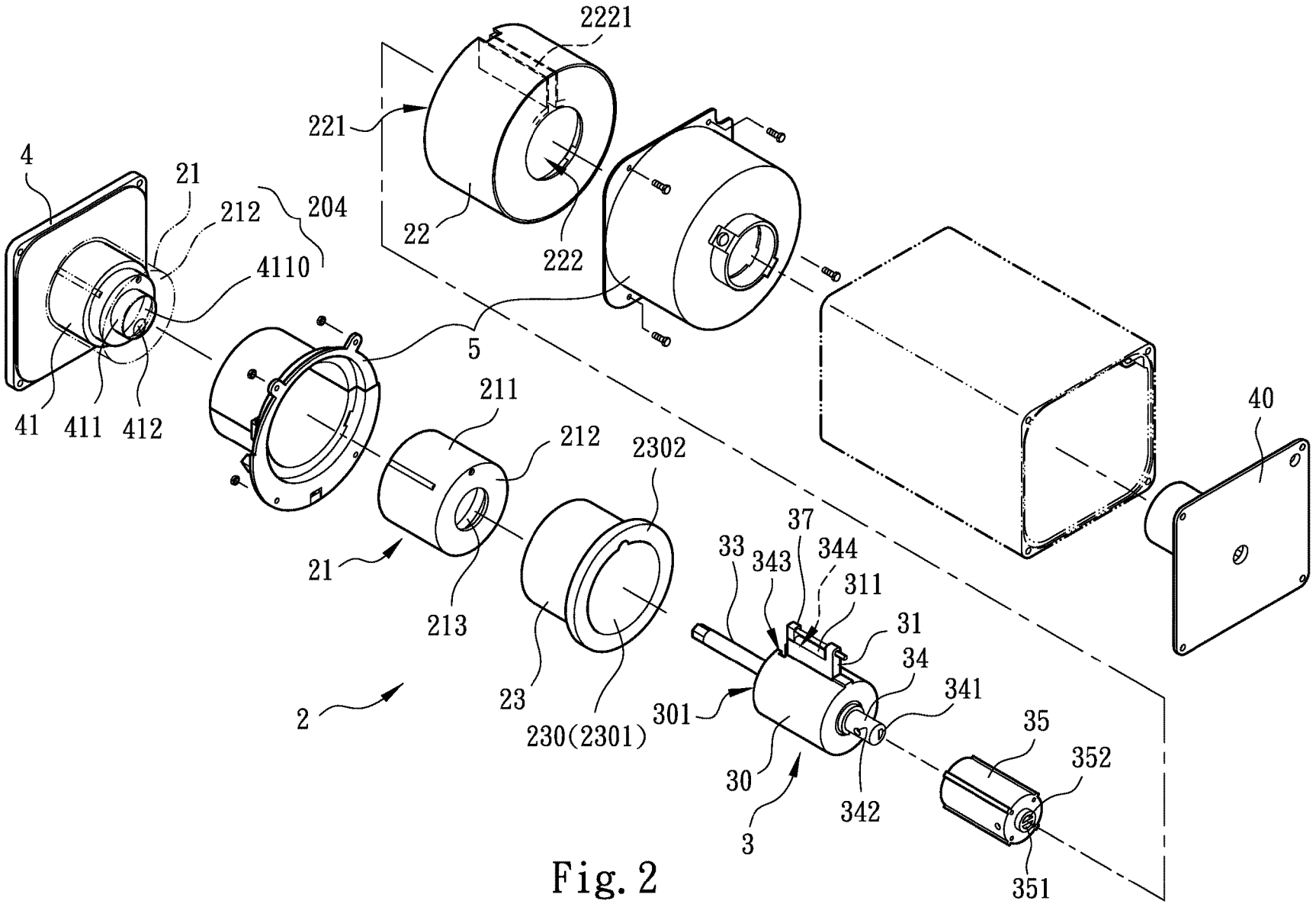
FIG. 2 is a perspective exploded view of a first preferred embodiment of the present invention.
Figure 3:
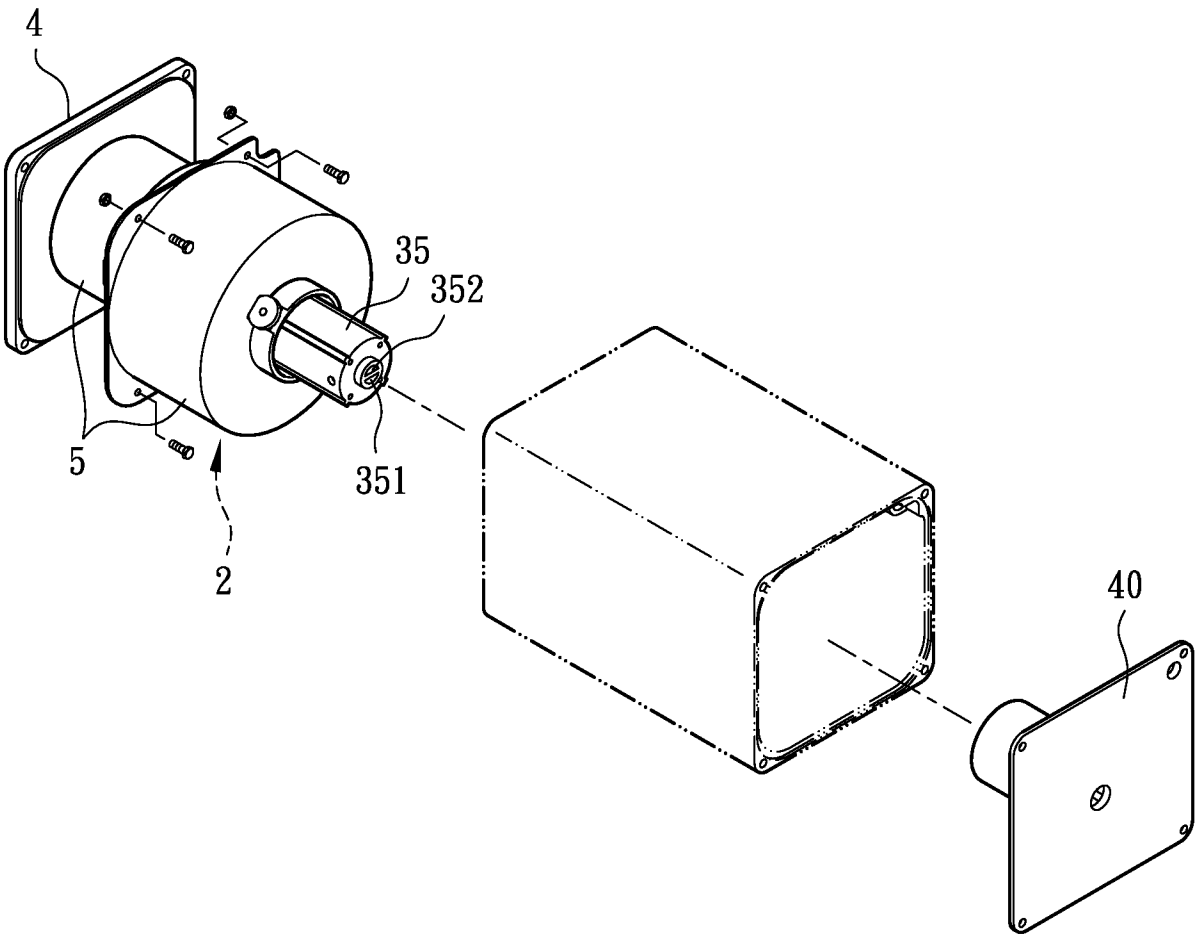
FIG. 3 is a perspective partially assembled view of the first preferred embodiment of the present invention according to FIG. 2.
Figure 4:
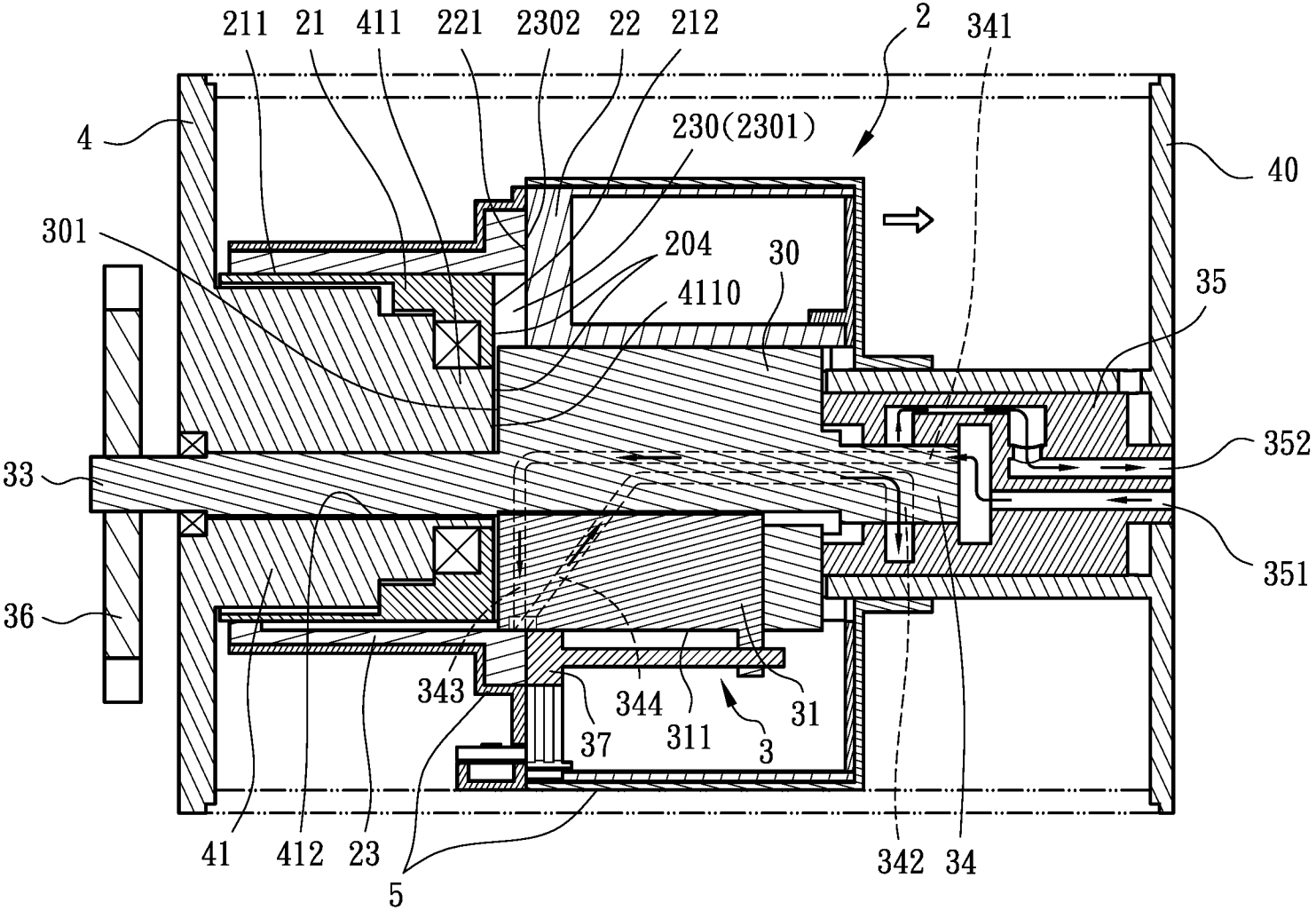
FIG. 4 is a sectional assembled view of the first preferred embodiment of the present invention according to FIG. 2, showing that the space of the vane chamber is relatively smaller than the space of the vane chamber of FIG. 4-1.
Figures 1, 4:
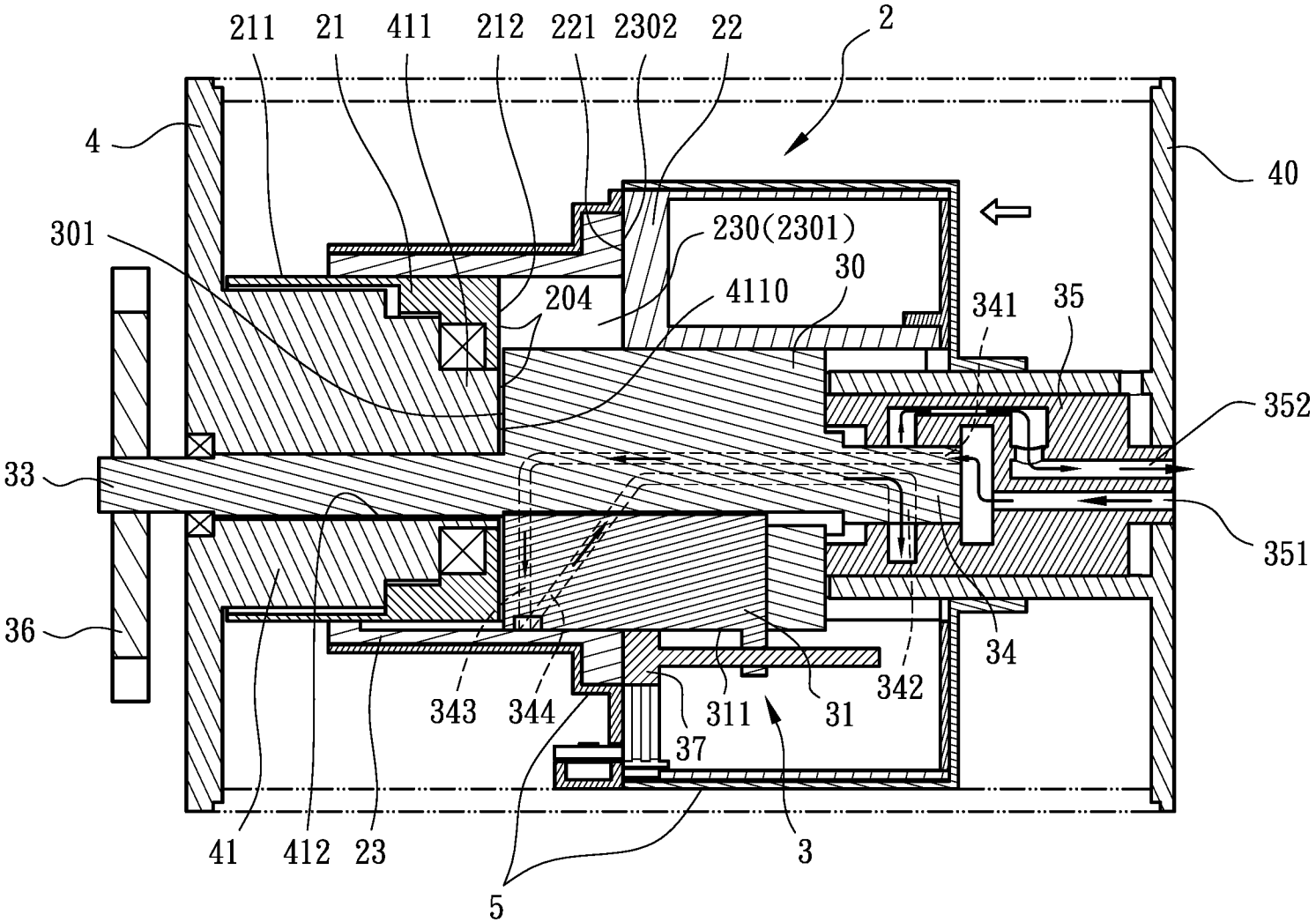

Please refer to FIGS. 2 to 4. The present invention is mainly composed of a vane chamber body 2, a vane rotor 3, a first support body 4 and a second support body 40. The vane chamber body 2 is at least composed of a fixed wall member 21, a movable wall member 22 and a movable vane chamber sleeve 23. The movable wall member 22 and the movable vane chamber sleeve 23 are movable in an axial direction of the vane rotor 3 and displaceable relative to the fixed wall member 21. At least one vane chamber 230 is defined between the fixed wall member 21, the movable wall member 22 and the movable vane chamber sleeve 23. When the movable wall member 22 and the movable vane chamber sleeve 23 are moved in the axial direction of the vane rotor 3 and displaced relative to the fixed wall member 21, the capacity of the vane chamber 230 is changed.

According to the above principle, in a first embodiment of the present invention (as shown in FIGS. 2 to 5), the fixed wall member 21 has two parts of fixed wall seat sleeve 211 and fixed wall end face 212. The fixed wall end face 212 is disposed at one end of the fixed wall seat sleeve 211 and normal to the axis of the vane rotor 3. A fixed wall hole 213 is formed at a center of the fixed wall end face 212. The fixed wall seat sleeve 211 of the fixed wall member 21 is capped on a base seat 41 having a fixed wall end boss 411. The fixed wall end boss 411 is tightly fully plugged in the fixed wall hole 213, whereby a boss end face 4110 of the fixed wall end boss 411 and the fixed wall end face 212 together form a fixed wall face 204. In a preferred structural form, the base seat 41 can be detachably disposed on the first support body 4 or integrally securely formed on the first support body 4.

Figure 5:
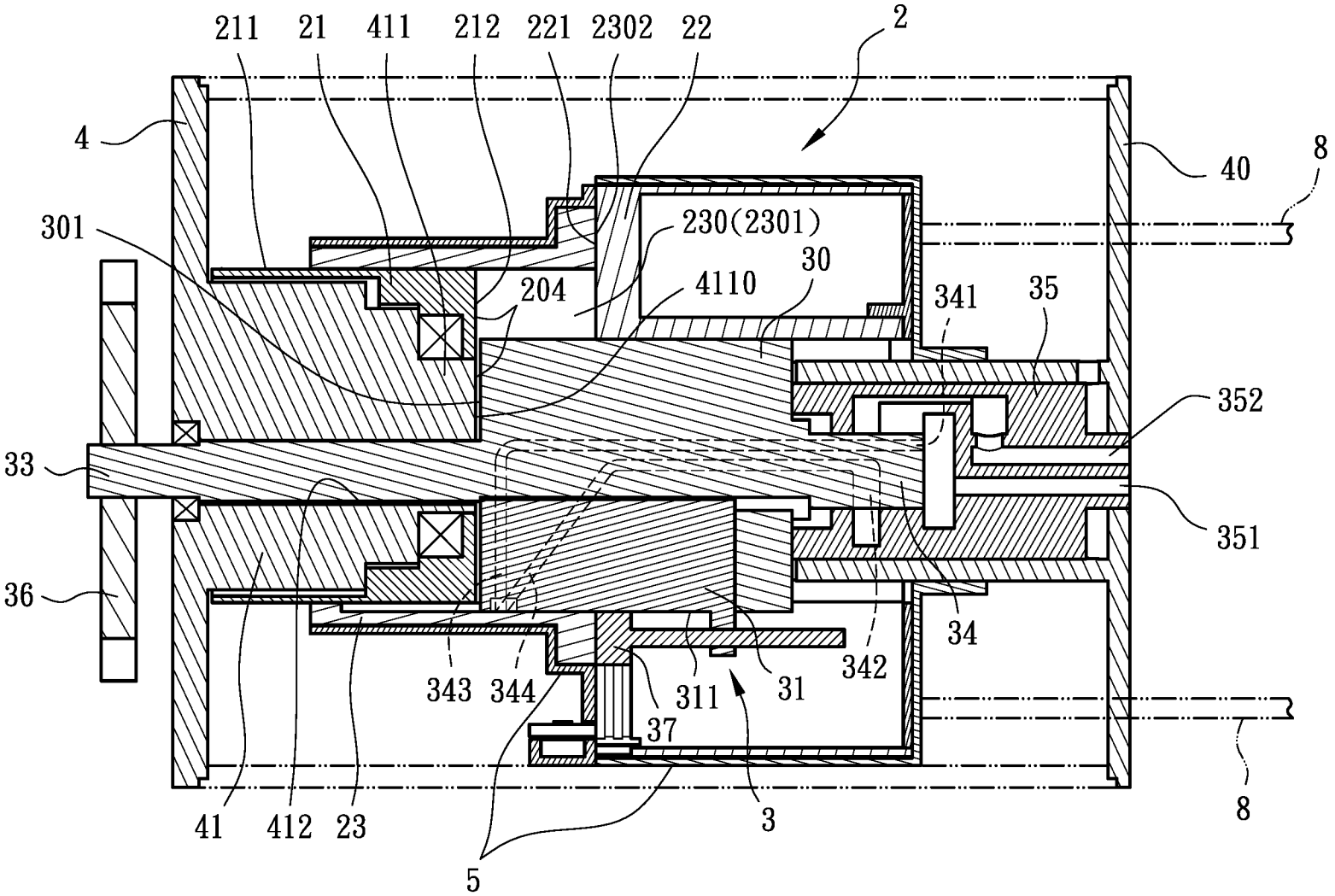
FIG. 5 is a sectional assembled view of the first preferred embodiment of the present invention according to FIG. 2, showing that a forcing mechanism is used to drive the movable wall member.
Figure 6:
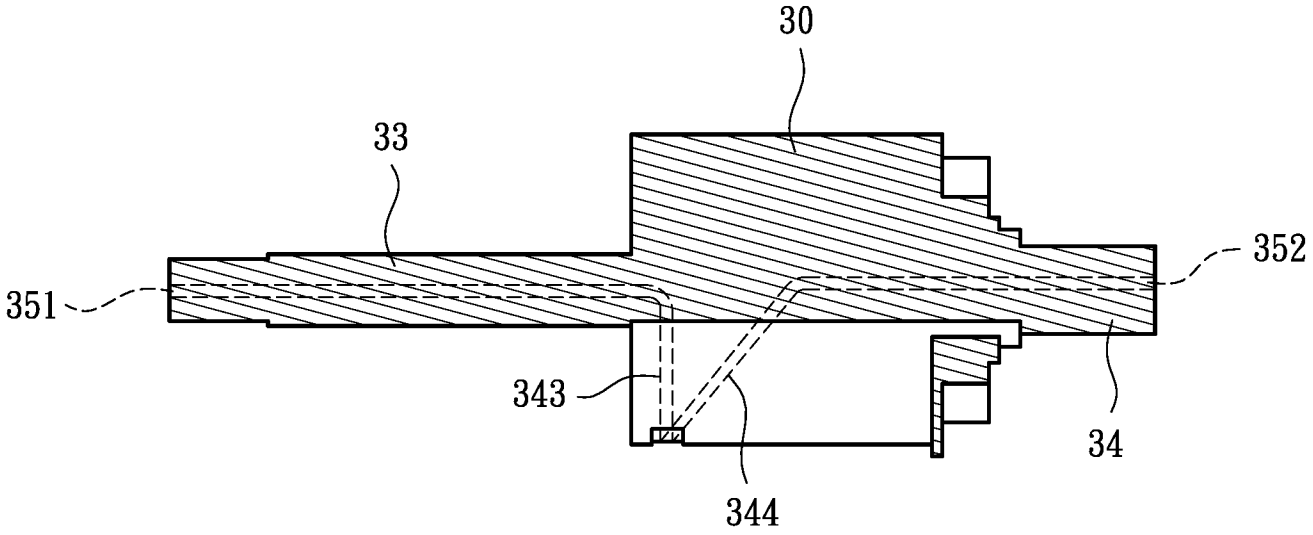
FIG. 6 is a sectional assembled view of the first preferred embodiment of the present invention according to FIG. 2, showing that the suction passage and discharge passage respectively communicate with outer side via two shaft ends of the vane rotor.
Figure 11:
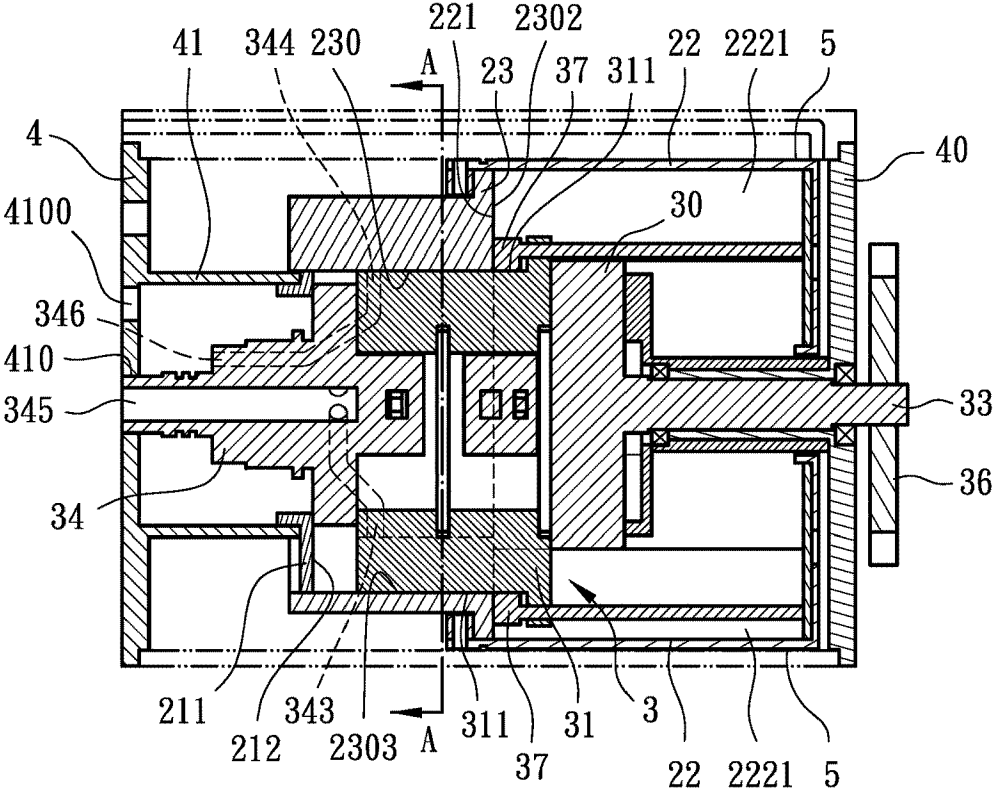
FIG. 11 is an axially sectional assembled view of the second preferred embodiment of the present invention according to FIG. 9.

The vane rotor 3 has at least one impeller 30 and at least one vane 31 assembled with the impeller 30. The vane 31 is radially slidable and extendable/retractable. The impeller 30 has an end face 301 normal to the axis vane rotor 3. The end face 301 can tightly attach to the fixed wall face 204. The vane rotor 3 has a first rotor shaft 33, which can be pivotally fitted in an eccentric rotor shaft hole 412 formed on the base seat 41. The first rotor shaft 33 is further passed through the first support body 4 to externally connect with a transmission member 36 for receiving power or bearing a load. The vane rotor 3 further has a second rotor shaft 34, in which a first suction/discharge port 341 and a second suction/discharge port 342 are formed. A first suction/discharge passage 343 and a second suction/discharge passage 344 are formed in the vane rotor 3 respectively in communication with the first and second suction/discharge ports 341, 342. The first and second suction/discharge passages 343, 344 respectively extend to further communicate with a suction side and a discharge side on two sides of the vane 31 into communication with the vane chamber 230. The second rotor shaft 34 can be directly pivotally disposed on the second support body 40. Alternatively, as shown in FIGS. 2 to 5, a fluid suction/discharge port member 35 can be first fitted on the second rotor shaft 34 and then the fluid suction/discharge port member 35 is disposed on the second support body 40. The fluid suction/discharge port member 35 has a first suction/discharge passage 351 and a second suction/discharge passage 352. The second rotor shaft 34 is pivotally fitted in the fluid suction/discharge port member 35 and rotated relative to the fluid suction/discharge port member 35. Therefore, with the fluid suction/discharge port member 35 serving as a fluid connection interface (as shown in FIGS. 4 and 5), the first and second suction/discharge ports 341, 342 of the second rotor shaft 34 can correspondingly communicate with the first and second suction/discharge passages 351, 352 of the fluid suction/discharge port member 35, whereby the first and second suction/discharge ports 341, 342 and the internal fluid passages of the second rotor shaft 34 can be converted from an original rotating state into a stationary state. Accordingly, in continuous operation of the vane rotor 3, the first and second suction/discharge ports 341, 342 and the internal fluid passages of the second rotor shaft 34 can keep in connection with an external fluid input source and an external fluid output source. The first and second suction/discharge passages 343, 344 in the vane rotor 3 can have various forms in addition to the above form. For example, as shown in FIG. 6, the first and second suction/discharge passages 343, 344 can communicate with outer side via the first and second rotor shafts 33, 34 of the vane rotor 3. Alternatively, as shown in FIG. 11, the first and second suction/discharge passages 343, 344 can respectively communicate with a shaft center 345 and shaft non-center 346 of the second rotor shaft 34 and then connect with the outer side directly via a suction/discharge passage 410 and a suction/discharge passage 4100 disposed on the base seat 41 and/or the first support body 4.

The movable wall member 22 is fitted around the vane rotor 3 and is axially slidable to fit around the impeller 30. The movable wall member 22 has a movable wall face 221. The movable wall face 221 is tightly attached to a vane chamber sleeve end face 2302 of the movable vane chamber sleeve 23, which faces the movable wall member 22. A fitting hole 222 is formed at a center of the movable wall member 22, which is axially slidable to fit around the impeller 30. An inner wall of the fitting hole 222 is formed with a vane receiving slot 2221 corresponding to the vane 31. The vane 31 can slide into the vane receiving slot 2221, whereby when the movable wall member 22 relatively axially approaches the fixed wall member 21, more part of the vane 31 can slide into the vane receiving slot 2221. The vane chamber 230 is defined in the movable vane chamber sleeve 23. The vane chamber 230 can axially slide to fit around the fixed wall member 21 and the impeller 30. The vane chamber 230 is defined between the movable vane chamber sleeve 23, the fixed wall end face 212, the movable wall face 221 and the vane rotor 3. The impeller 30 occupies a part of the vane chamber 230. The remaining space of the vane chamber 230 forms at least one eccentric vane chamber section 2301 eccentric to the axis of the vane rotor 3. The vane 31 has a vane top edge 311 distal from the vane rotor 3. The vane top edge 311 tightly attaches to the inner wall of the vane chamber 230 and is axially and/or circumferentially slidable relative to the inner wall of the vane chamber 230. In addition, proper sealing and leakproof members can be disposed between the contacting sections of the vane 31 and the inner wall of the vane chamber 230 and between the tightly attaching or relatively displacing sections of the fixed wall member 21, the movable wall member 22, the movable vane chamber sleeve 23 and the vane rotor 3 so as to prevent the fluid in the operating vane chamber 230 from leaking through the aforesaid sections. Especially, at the inter-contacting sections of the vane top edge 311 of the vane 31, the movable wall member 22 and the movable vane chamber sleeve 23, the curve of the configuration of the vane top edge 311, the cross-sectional curve of the vane receiving slot 2221 of the movable wall member 22, into which the vane top edge 311 can slide and the curve of the inner wall of the vane chamber 230 of the movable vane chamber sleeve 23 in contact with the vane top edge 311 are different from each other. Therefore, minor gaps exist between the inter-contacting sections of the vane top edge 311 of the vane 31, the movable wall member 22 and the movable vane chamber sleeve 23. As a result, in operation, the vane chamber 230 cannot be fully closed. In order to solve this problem, a sealing block 37 is disposed on the vane top edge 311, which can tightly attach to the vane top edge 311 to synchronously slide with the vane 31. The sealing block 37 is further restricted in the intersection path of the vane receiving slot 2221 of the movable wall member 22 and the outer edge of the inner wall of the vane chamber 230 of the movable vane chamber sleeve 23. Accordingly, in operation, the sealing block 37 always seals the inter-contacting sections of the vane top edge 311, the vane receiving slot 2221 and the outer edge of the inner wall of the vane chamber 230 and blocks the gaps to achieve good sealing and leakproof effect. A retainer member 5 can be assembled between the movable wall member 22 and the movable vane chamber sleeve 23 so as to keep the movable wall member 22 and the movable vane chamber sleeve 23 attach to and assemble with each other, whereby the movable wall member 22 and the movable vane chamber sleeve 23 can synchronously axially slide. (The retainer member 5 can have various structural forms and will not be redundantly described hereinafter).

According to the above assembled structure, in operation, when the vane rotor 3 drives the vane 31 to sweep within the eccentric vane chamber section 2301, the fluid on the forward side of the sweeping direction of the vane 31 is compressed and discharged as a discharge side. The fluid positioned on the other side of the vane 31 is sucked in as a suction side. In addition, the eccentric vane chamber section 2301 is eccentric to the axis of the vane rotor 3 so that the area of the fixed wall face 204 per unit angle, which the vane 31 sweeps over in the eccentric vane chamber section 2301, will continuously change along with the rotation of the vane rotor 3. This phenomenon is equivalent to that the intersection area of the movable wall face 221 on two sides of the vane 31 and the interior of the eccentric vane chamber section 2301 and the suction/discharge amount of the fluid on two sides of the vane 31 will both change along with the change of the sweeping position of the vane 31. Also, the space of the eccentric vane chamber section 2301, which is occupied by the vane 31, is relatively changed. This leads to some difference between the fluid amount discharged from the discharge side of the vane 31 and the fluid amount sucked into the suction side of the vane 31. Moreover, under the forced push of an external forcing member 8 (as shown in FIG. 5) or under the action of the differences between the flow amount of the operation fluid and the pressure, the movable wall member 22 in association with the movable vane chamber sleeve 23 is fitted on the vane rotor 3 and the fixed wall seat sleeve 211 to relatively axially displace. When the movable wall face 221 gradually axially gets close to the fixed wall face 204, the available suction/discharge capacity of the eccentric vane chamber section 2301 is relatively gradually reduced. Reversely, when the movable wall face 221 gradually axially moves away from the fixed wall face 204, the available suction/discharge capacity of the eccentric vane chamber section 2301 is gradually increased. Accordingly, a pump with variable suction/discharge amount, which is axially extendable/retractable to change the suction/discharge amount of the vane chamber 230, is formed.

Accordingly, the above pump with variable suction/discharge amount can be applied to and assembled with a closed loop. The closed loop outputs and inputs an operation fluid to the vane chamber 230 and the external forcing member 8 forcedly pushes the pump to transfer the operation fluid. In the transfer process of the operation fluid, the pressure in the vane chamber 230 is changed. The change amount of the pressure acts between at least one of the movable wall member 22 and the movable vane chamber sleeve 23 and the fixed wall member 21, whereby the movable wall member 22 and/or the movable vane chamber sleeve 23 and the fixed wall member 21 displace relative to each other so as to change capacity of the vane chamber 230. Accordingly, the output amount and input amount of the operation fluid pushed by the rotating vane rotor 3 to pass the vane chamber 230 per unit time are variable with the change of the capacity of the vane chamber 230, whereby the vane rotor 3 can provide power transmission at different rotational speeds according to the change of the capacity of the vane chamber 230.

Figure 7:
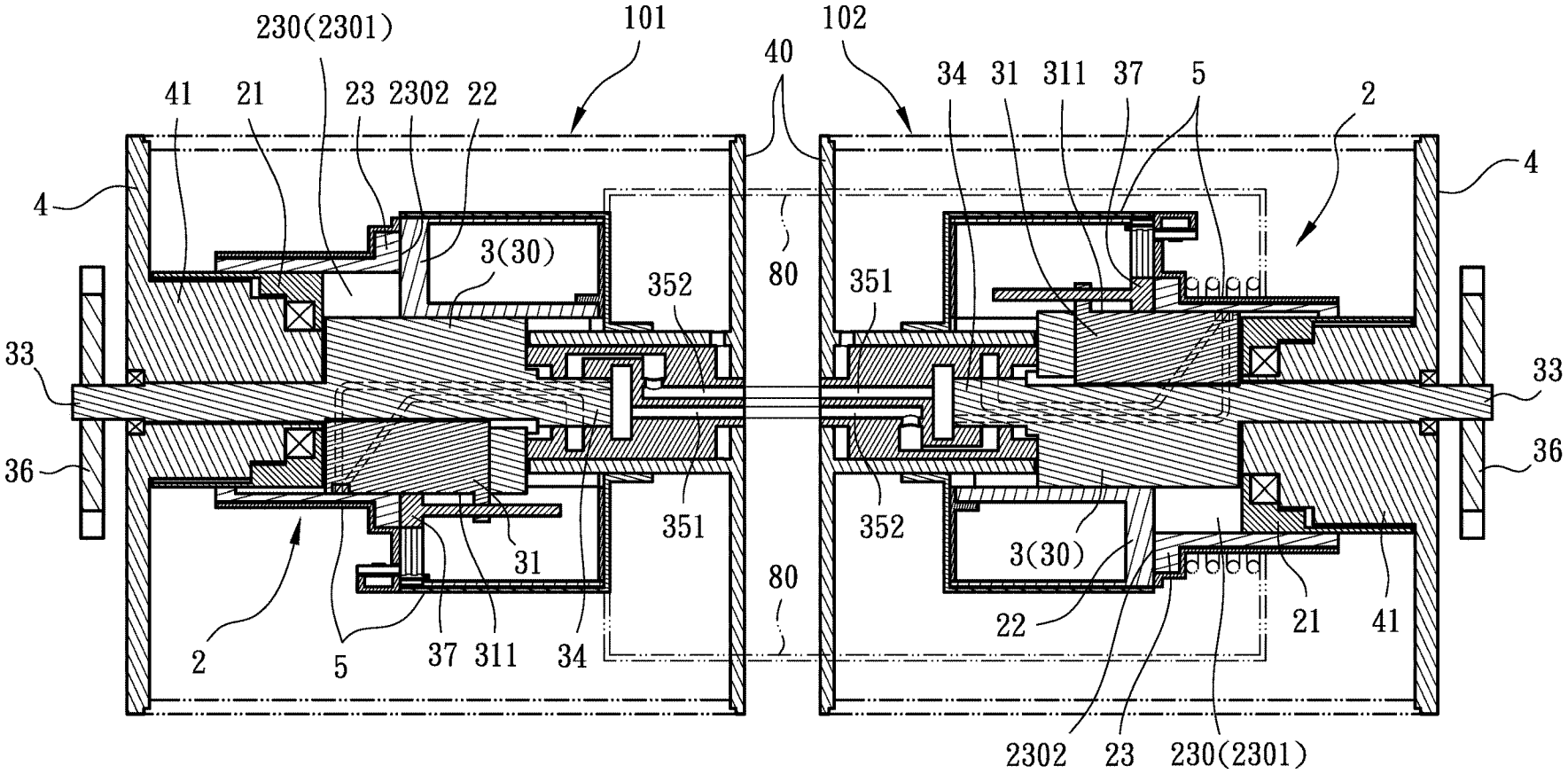
FIG. 7 is a sectional assembled view of the first preferred embodiment of the present invention according to FIG. 2, showing that a active pump is assembled with a passive pump, wherein a same-direction displacement connection member is connected between at least one of the movable wall member and the movable vane chamber sleeve of the active pump and the passive pump.
Figures 1, 7:
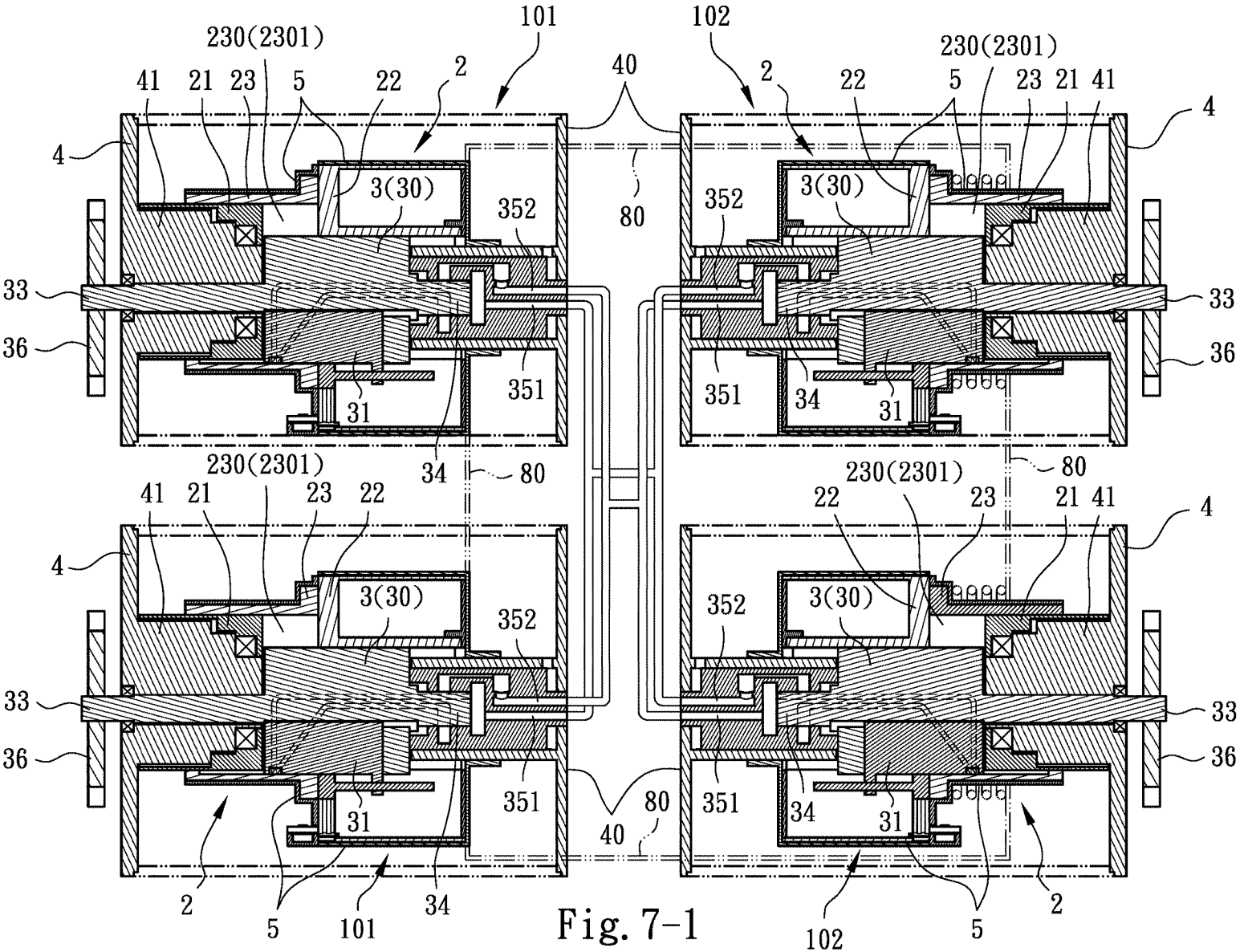
Figures 2, 7:
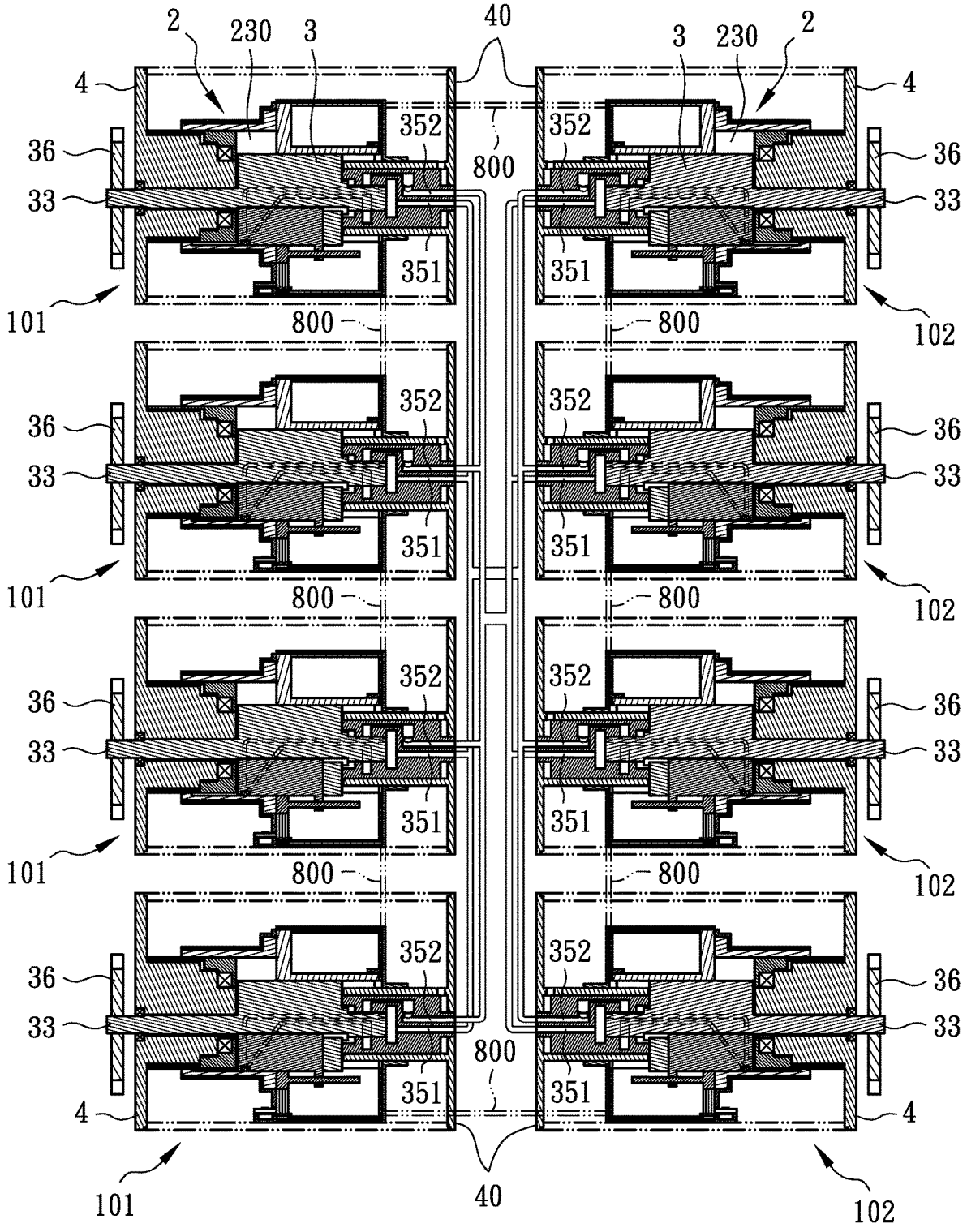
Figures 3, 7:
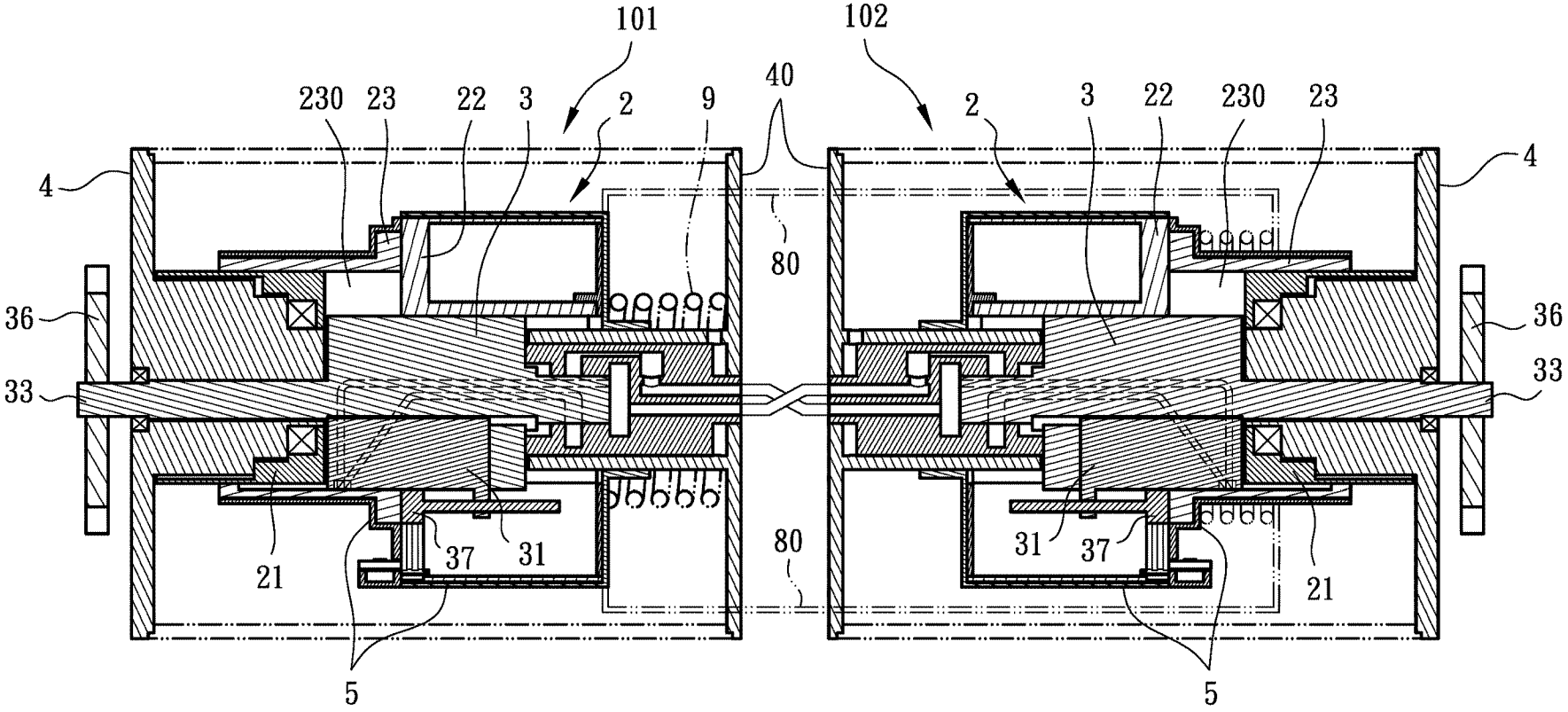
Figures 4, 7:
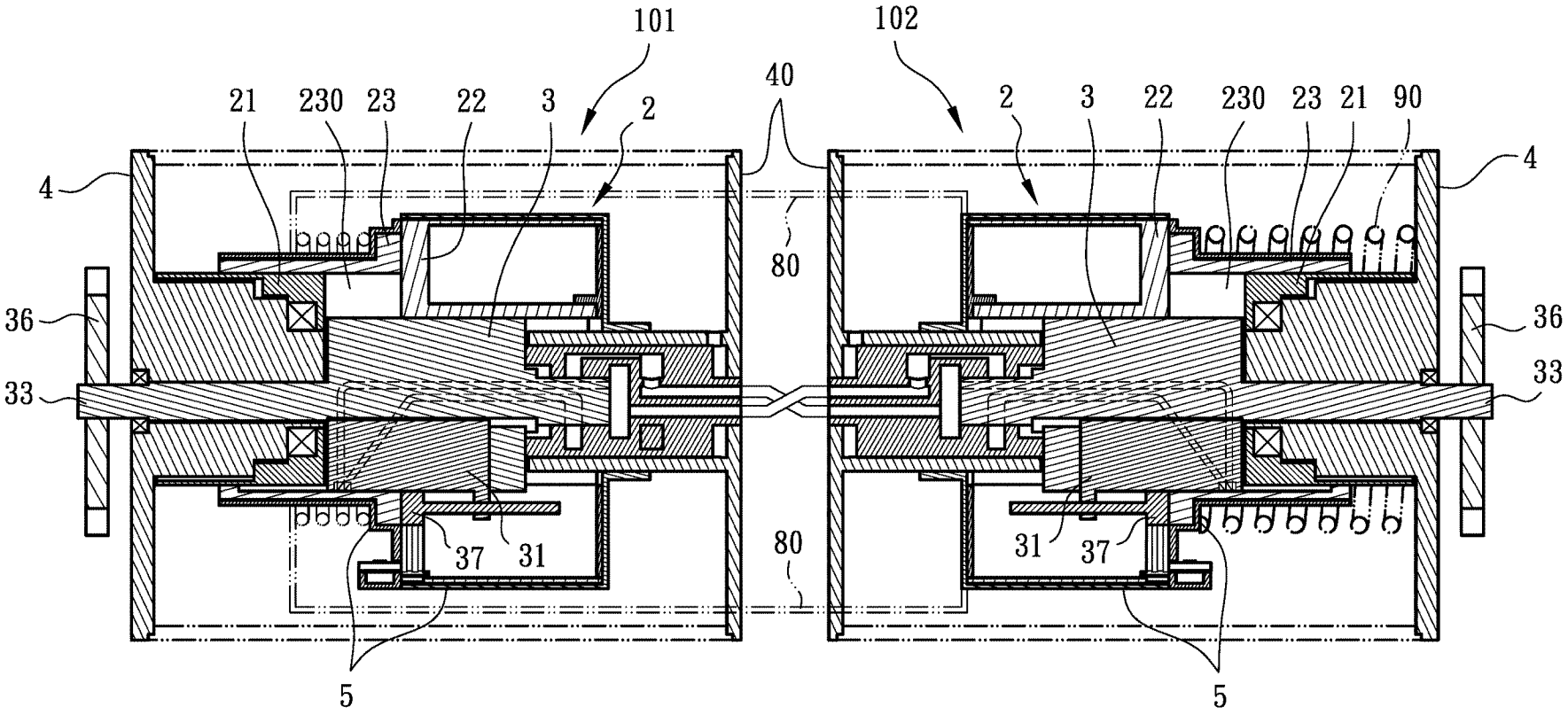

As shown in FIG. 7, two pumps with variable suction/discharge amount of the present invention are oppositely arranged in communication with each other. The suction port and discharge port of the first suction/discharge passage 351 and second suction/discharge passage 352 of the two oppositely arranged pumps are in communication with each other. Accordingly, in case the pump of the two oppositely arranged pumps on the left side of the drawing is set a active pump 101, while the pump on the right side is set a passive pump 102 and the discharge passage of the active pump 101 is in communication with the suction passage of the passive pump 102, the fluid discharged from the discharge passage of the active pump 101 can enter the suction passage and the suction side of the vane 31 of the passive pump 102. Reversely, in case the discharge passage of the passive pump 102 is in communication with the suction passage of the active pump 101, the fluid on the discharge side of the vane 31 of the passive pump 102 is discharged from the discharge passage and then flows back to the suction passage and the suction side of the vane 31 of the active pump 101, whereby the vane chambers and the entire suction and discharge passages of the active pump 101 and the passive pump 102 form a close loop for the active pump 101 to drive the passive pump 102. In addition, a same-direction displacement connection member 80 is connected between at least one of the movable wall member 22 and the movable vane chamber sleeve 23 of the active pump 101 and the passive pump 102, whereby the movable wall member 22 and the movable vane chamber sleeve 23 of the active pump 101 and the passive pump 102 can move together in the same axial direction. In operation of the closed loop of the active pump 101, in case the employed fluid is a liquid phase fluid and the total volume of the liquid is constant, then the liquid phase fluid on the discharge side in the eccentric vane chamber section 2301 of the active pump 101 will be pushed by the vane 31 of the rotating vane rotor 3 to the suction side of the passive pump 102. Relatively, the liquid phase fluid on the discharge side in the eccentric vane chamber section 2301 of the passive pump 102 will be pushed by the vane 31 of the rotating vane rotor 3 to the suction side of the active pump 101. Accordingly, a complete liquid phase fluid driving loop of the active pump and the passive pump is formed. In operation of the driving loop, the driving force of the active pump 101 rotates the vane rotor 3 to drive the vane 31 to apply a push pressure to the movable vane chamber sleeve 23, the fixed wall face 204 and the movable wall face 221 positioned on the discharge side of the vane 31 in the eccentric vane chamber section 2301 of the active pump 101 and the vane face of the vane 31, the movable vane chamber sleeve 23, the fixed wall face 204 and the movable wall face 221 positioned on the suction side of the vane 31 in the eccentric vane chamber section 2301 of the passive pump 102. On the other hand, after pushed, a vacuum sucking force is applied to the movable vane chamber sleeve 23, the fixed wall face 204 and the movable wall face 221 positioned on the suction side of the vane 31 in the eccentric vane chamber section 2301 of the active pump 101 and the vane face of the vane 31, the movable vane chamber sleeve 23, the fixed wall face 204 and the movable wall face 221 positioned on the discharge side of the vane 31 in the eccentric vane chamber section 2301 of the passive pump 102. The direction of the push pressure or vacuum sucking force applied to the movable vane chamber sleeve 23 is normal to the axial moving direction of the movable vane chamber sleeve 23 so that the push pressure or vacuum sucking force cannot directly make the movable vane chamber sleeve 23 displace. The fixed wall face 204 is fixed and unmovable. Therefore, during the driving process, only the movable wall face 221 will bear the push pressure or vacuum sucking force to make the movable wall member 22 axially move. At the same time, the movable vane chamber sleeve 23 is passive to tightly attach to the movable wall member 22 and synchronously axially move. Two sides of the vane 31 in the passive pump 102 are respectively double-affected by the push pressure and the vacuum sucking force in the same direction, whereby the vane 31 is passive to drive and rotate the vane rotor 3 so as to output power to the load end of the passive pump 102. At the beginning of the driving process, the passive pump 102 is situated in a stationary state. The vane rotor 3 of the active pump 101 starts to be rotated under the driving force, whereby the liquid phase fluid on the discharge side of the vane 31 starts to be pushed and compressed. At this time, in case the area of the movable wall face 221 on the discharge side of the vane 31 in the eccentric vane chamber section 2301 of the active pump 101 is larger than the area of the movable wall face 221 on the suction side of the vane 31 in the eccentric vane chamber section 2301 of the passive pump 102, due to that the larger the forced area is, the greater the push pressure applied to the forced area is and due to that a load force is applied to the vane 31 of the passive pump 102, then the movable wall member 22 and the movable vane chamber sleeve 23 of the active pump 101 will gradually axially displace in a direction away from the fixed wall face 204 to enlarge the axial space of the eccentric vane chamber section 2301. At the same time, a sucking force is applied to the suction side of the vane 31 of the passive pump 102, whereby the movable wall member 22 and the movable vane chamber sleeve 23 of the passive pump 102 are sucked to axially displace in a direction toward the fixed wall face 204. At this time, the area of the movable wall face 221 on the suction side of the vane 31 in the eccentric vane chamber section 2301 of the active pump 101 is smaller than the area of the movable wall face 221 on the discharge side of the vane 31 in the eccentric vane chamber section 2301 of the passive pump 102. Therefore, after the vane 31 of the active pump 101 sweeps, the vacuum sucking force applied to the suction side of the vane 31 provides greater sucking driving force for the movable wall face 221 in the passive pump 102 with larger area. As a result, the movable wall member 22 and the movable vane chamber sleeve 23 of the active pump 101 will displace in a direction away from the fixed wall face 204. The movable wall member 22 and the movable vane chamber sleeve 23 of the passive pump 102 will displace in a direction toward the fixed wall face 204. Similarly, when the sizes of the areas of the movable wall faces 221 on the discharge side and the suction side of the vane 31 are compared with each other to be on the contrary to the above, the movable wall member 22 and the movable vane chamber sleeve 23 of the active pump 101 and the passive pump 102 will displace in a direction reverse to the above direction. During the operation process of the closed loop, the movable wall member 22 and the movable vane chamber sleeve 23 will continuously reciprocally axially displace as aforesaid until the liquid phase fluid originally on the suction side of the vane 31 of the active pump 101 and the liquid phase fluid originally in the passage of the discharge side of the vane 31 of the passive pump 102 are passive and circulated and switched to be respectively on the discharge side of the vane 31 of the active pump 101 and in the passage of the suction side of the vane 31 of the passive pump 102. In addition, after switched, the volume of the liquid phase fluid in the passage has become larger than the sum of the allowable modulated maximal capacity on the discharge side of the vane 31 of the active pump 101 and the suction side of the vane 31 of the passive pump 102 by means of axial displacement. The same-direction displacement connection member 80 is connected between the active pump 101 and the passive pump 102 and the liquid is uncompressible so that along with the driving of the vane 31 of the active pump 101, the vane face on the suction side of the vane 31 in the passive pump 102 will entirely bear the push force of the liquid phase fluid to gradually push and the passive pump 102 and the load end thereof. Therefore, the active/passive pump closed loop will gradually start to operate.

Therefore, in application of the transmission drive device composed of the above components, in case the closed loop outputs and inputs an operation fluid to the respective vane chambers 230 of the active pump 101 and the passive pump 102, by means of the forced push of the external forcing member 8 or the change amount of the pressure applied to the interior of the vane chamber 230 by the operation fluid during the push and transfer process, the push acts between at least one of the movable wall member 22 and the movable vane chamber sleeve 23 and the fixed wall member 21, whereby the movable wall member 22 and/or the movable vane chamber sleeve 23 and the fixed wall member 21 displace relative to each other so as to change the capacity of the vane chamber 230. Accordingly, the active pump 101 and the passive pump 102 can make the rotational speeds of the corresponding vane rotors 3 in inverse proportion to each other respectively according to the change of the capacity of the corresponding vane chambers 230 to provide power transmission.

During the operation process of the active/passive pump loop, the movable wall members 22 and the movable vane chamber sleeves 23 of the active pump 101 and the passive pump 102 will continuously reciprocally axially displace. Therefore, the driving force applied to the vane 31 of the passive pump 102 by the active pump 101 will be interrupted. As a result, the rotation of the passive pump 102 will be undulated. Moreover, in the above embodiment, each of the active pump and the passive pump has one single vane chamber and one single vane. In case at the beginning of actuation of the passive pump, the vane of the passive pump is positioned in a position where the vane is right fully inlaid in the vane rotor, there is no vane face in the passive pump to bear the driving force. Under such circumstance, the active pump is situated in an invalid idling state and cannot apply any driving force to the passive pump. As a result, the entire loop will idle. In order to avoid the above condition of undulated operation or idling of the loop, as shown in FIG. 7-1, two active pumps 101 (or a active pump 101 with two eccentric vane chamber sections 2301) can be coupled with two passive pumps 102 (or a passive pump 102 with two eccentric vane chamber sections 2301). Alternatively, as shown in FIG. 7-2, four active pumps 101 (or a active pump 101 with four eccentric vane chamber sections 2301) can be coupled with four passive pumps 102 (or a passive pump 102 with four eccentric vane chamber sections 2301). After more active pumps and passive pumps are assembled with each other, the sums of the areas of the movable wall faces 221 on two sides of the vane 31 in the eccentric vane chamber sections 2301 are approximately or nearly equal to each other. Accordingly, the driving force of the assembly of multiple active pumps is temporarily balanced with the load resistance of the assembly of multiple passive pumps. Under such circumstance, the sums of the areas of the movable wall faces 221 on the discharge side and the suction side of the assembly of the active pumps and the passive pumps are approximately equal to each other. This can effectively improve the above condition of undulated operation. Also, due to that the multiple pumps are assembled, the angle phases of the respective vanes 31 positioned in the eccentric vane chamber sections 2301 can be arranged in a complementary relationship. Therefore, during any operation process, the assembly of the active pumps and the passive pumps always has a vane face for bearing the power without invalidate idling phenomenon of the loop. Therefore, the entire driving process can be smoother and more stable.

According to the above active/passive pump driving loop, especially the structural form composed of four active pumps 101 and four passive pumps 102 coupled therewith as shown in FIG. 7-2, the angle phase of each vane 31 positioned in the vane chamber 230 has another symmetrical vane 31 with an angle phase 180-degree different from the vane 31 as a complementary vane. Therefore, in the assembly of the four active pumps 101 and the four passive pumps 102, the sum of the areas of the movable wall faces 221 corresponding to the discharge side of the vane 31 in the eccentric vane chamber sections 2301 is nearly equal to the sum of the areas of the movable wall faces 221 corresponding to the suction side of the vane 31 in the eccentric vane chamber sections 2301. This is equivalent to that the discharge amount of the liquid phase fluid in the assembly of the four active pumps 101 and the four passive pumps 102 is nearly equal to the suction amount of the liquid phase fluid in the assembly of the four active pumps 101 and the four passive pumps 102. Accordingly, the entire loop can continuously stably operate. In the case that the driving force of the four active pumps 101 is unchanged, while the load of the four passive pumps 102 is increased, the sweeping speed of the vanes 31 of the four passive pumps 102 will be reduced. Under such circumstance, the liquid phase fluid will accumulate on the suction sides of the vanes 31 of the four passive pumps 102 to apply a capacity-enlarging push force to the movable wall faces 221. In addition, the amount of the liquid phase fluid flowing from the discharge sides of the vanes 31 of the four passive pumps 102 back to the suction sides of the vanes 31 of the four active pumps 101 is reduced to apply a vacuum sucking force to the movable wall faces 221. The sum of the areas of the movable wall faces 221 on the discharge side of the vane 31 in the eccentric vane chamber sections 2301 is nearly equal to the sum of the areas of the movable wall faces 221 on the suction side of the vane 31 in the eccentric vane chamber sections 2301 so that the total force applied to the movable wall faces 221 of the four active pumps 101 is nearly equal to the total force applied to the movable wall faces 221 of the four passive pumps 102. Under the action of the capacity-enlarging push force of the four passive pumps 102 and the vacuum sucking force of the four active pumps 101, the movable wall members 22 and the movable vane chamber sleeves 23 of the four active pumps 101 displace in a direction toward the fixed wall faces 204 to minify the total capacity of the four active pumps 101. At the same time, the movable wall members 22 and the movable vane chamber sleeves 23 of the four passive pumps 102 displace in a direction away from the fixed wall faces 204 to enlarge the total capacity of the four passive pumps 102. Therefore, the four active pumps 101 must circularly input the power many times so as to drive the four passive pumps 102 to circularly output the power one time. This is similar to a downshift driving effect in power transmission. Reversely, in the case that the driving force of the four active pumps 101 is unchanged, while the load of the four passive pumps 102 is reduced, all the above operation conditions are totally reversed. That is, the four active pumps 101 only need to circularly input the power one time for driving the four passive pumps 102 to circularly output the power many times. This is similar to an upshift driving effect in power transmission. It can be known from the aforesaid that in the operation of the closed driving loop composed of the four active pumps 101 and the four passive pumps 102, when the driving force and the load resistance change, the respective total capacities of the four active and passive pumps can be automatically adjusted so that the driving force and the load resistance can be automatically balanced with each other. Therefore, the drive device can smoothly automatically modulate the transmission according to the change of the driving force and the load resistance.

As shown in FIGS. 7, 7-1, 7-2, 7-3 and 7-4, in the condition that the suction/discharge amount per unit time of the active pump 101 and the suction/discharge amount per unit time of the passive pump 102 are nearly equal to each other, a same-direction displacement connection member 80 or a synchronous displacement connection member 800 is drivingly connected between the movable wall member 22 or the movable vane chamber sleeve 23 of the active pump 101 and the passive pump 102. An external force is applied to the same-direction displacement connection member 80 or the synchronous displacement connection member 800 to push the same so as to force the movable wall member 22 or the movable vane chamber sleeve 23 of the active pump 101 and the passive pump 102 to respectively same-direction or synchronously reversely displace away from or toward the corresponding fixed wall faces 204. Accordingly, it can be ensured that the increase amount or the decrease amount of the capacity of the vane chamber of the active pump 101 is nearly equal to or right equal to the decrease amount or the increase amount of the capacity of the vane chamber of the passive pump 102. In addition, a displacement resistant member 9 and a displacement resistant member 90 (such as a spring) can be additionally arranged in the increasing direction of the capacity of the vane chamber of the active pump 101 of FIG. 7-3 and the decreasing direction of the capacity of the vane chamber of the passive pump 102 of FIG. 7-4. Accordingly, the displacement resistant member 9 and the displacement resistant member 90 can provide an internal preload resistance against the rotational speed ratio automatic regulation effect achieved between the active pumps 101 and the passive pumps 102. Under such circumstance, the actually required input driving force needs to be slightly greater than the actually externally added load resistance. This preset balancing condition provides a forced downshift effect as a transmission mechanism.

Figure 8:
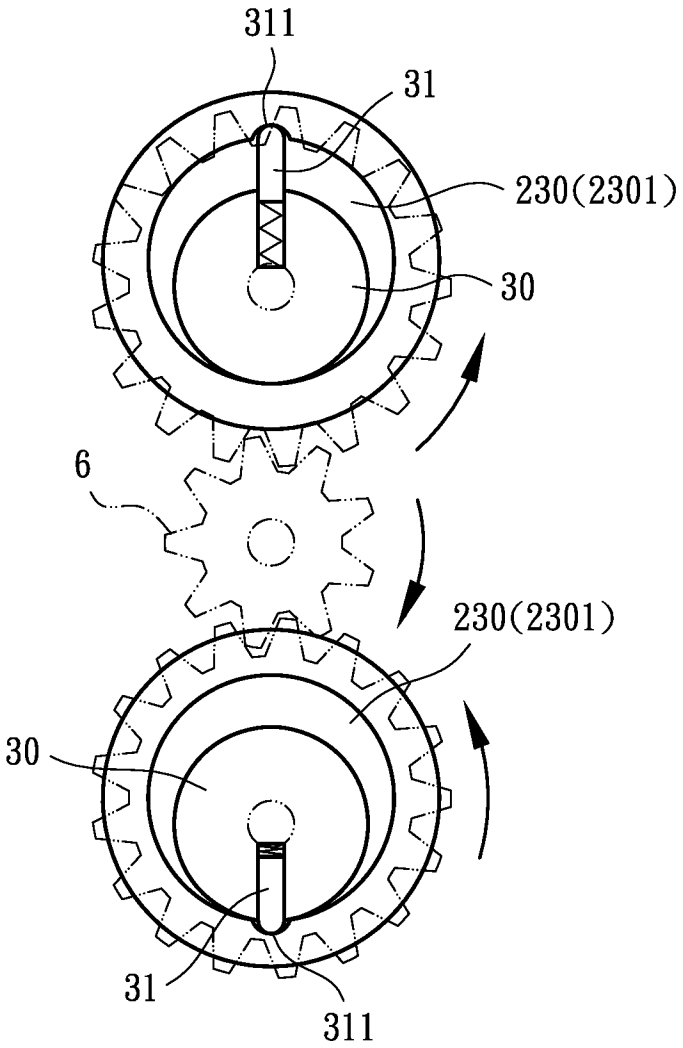
FIG. 8 is a sectional assembled view of the first preferred embodiment of the present invention according to FIG. 2, wherein two pumps are assembled to form a active pump end and a common engagement member is engaged between the two pumps to synchronously drive the two pumps.
Figures 1, 8:
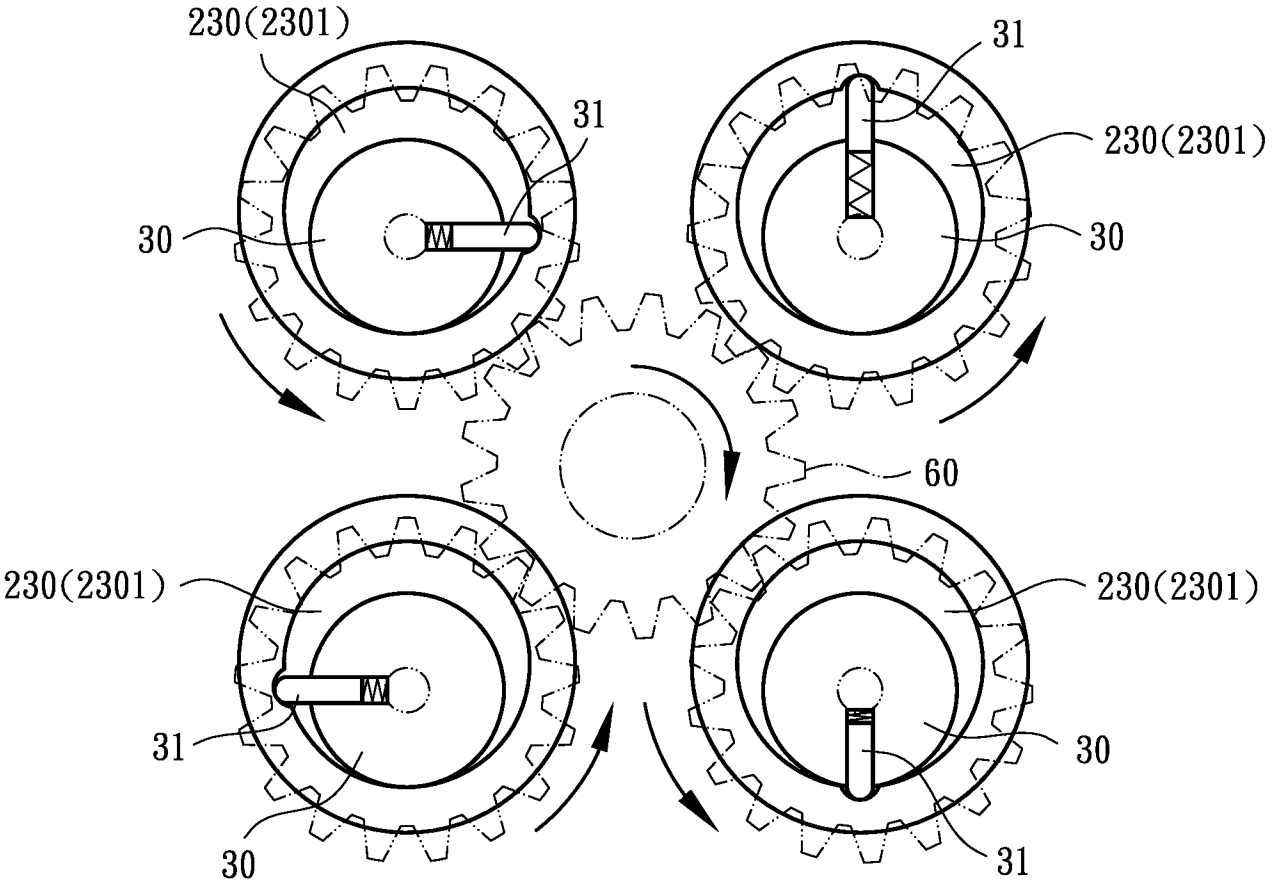
Figures 2, 8:
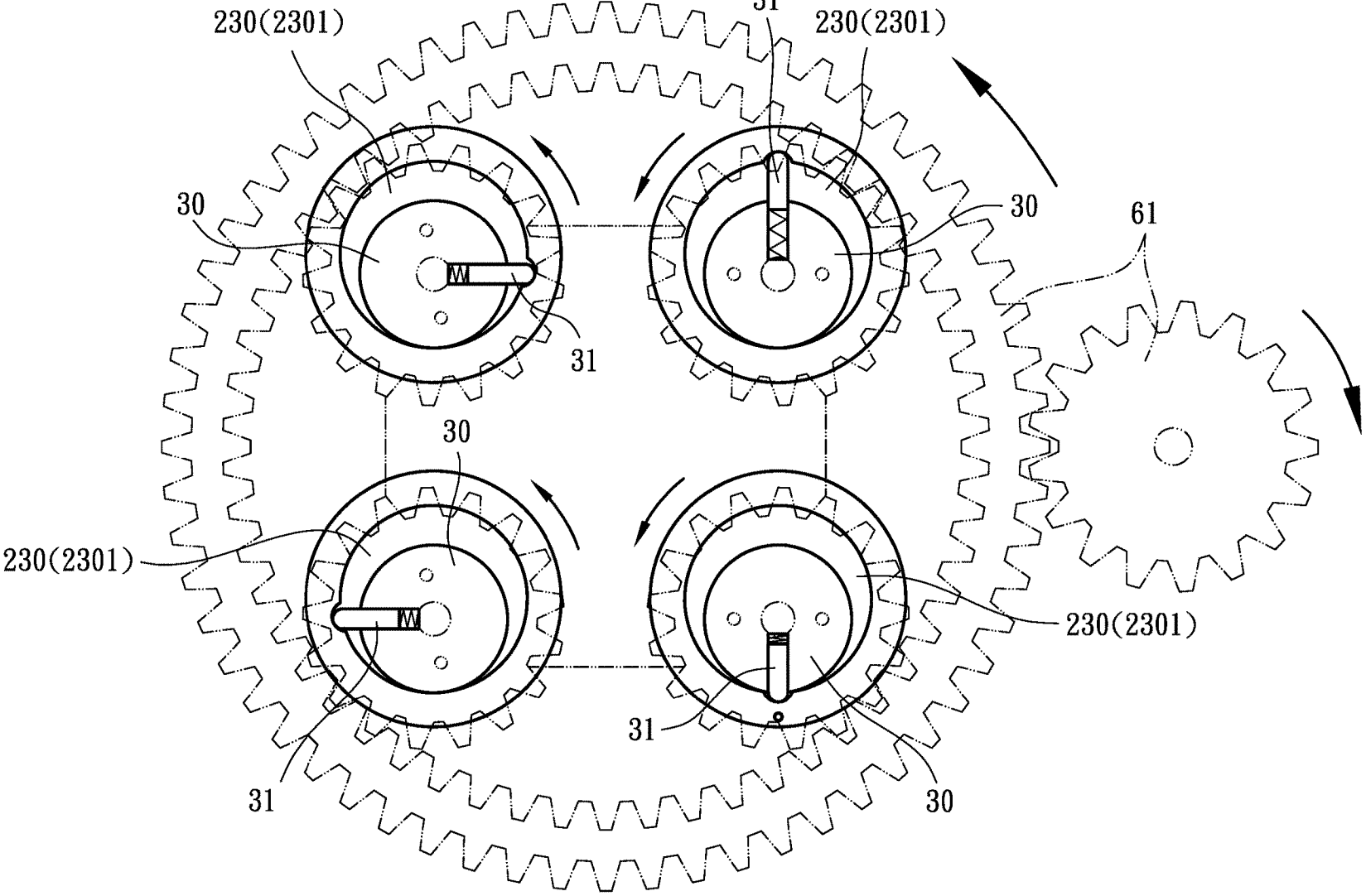
Figures 3, 8:
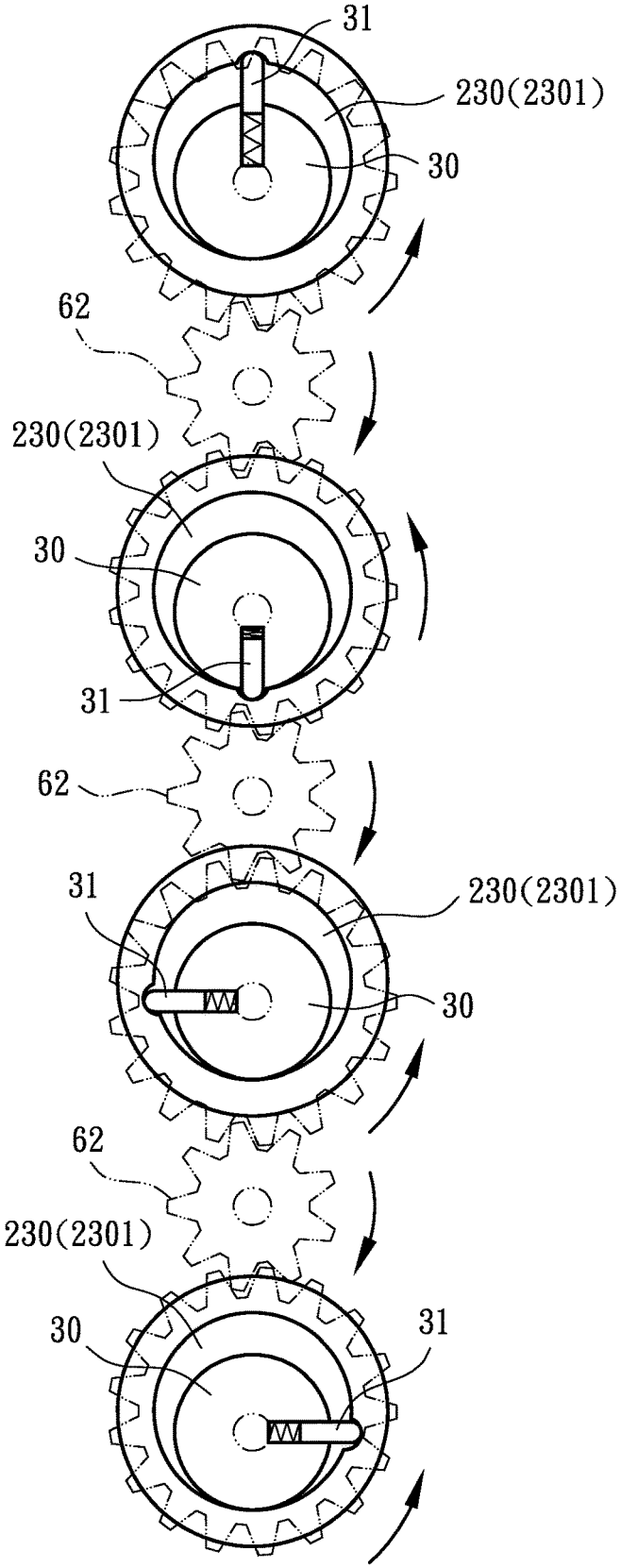
Figures 4, 8:
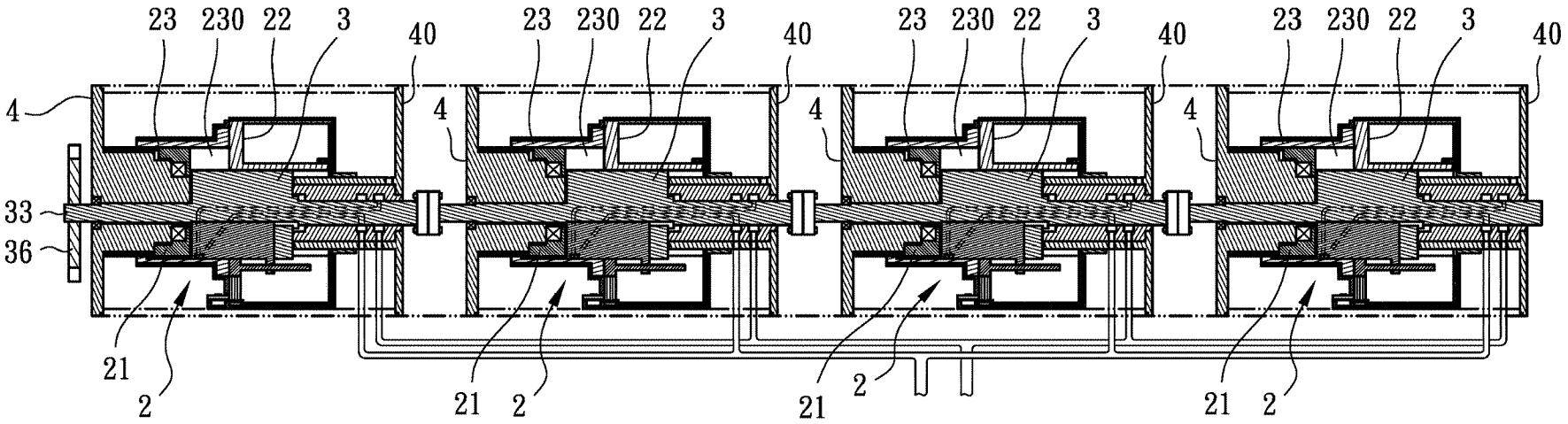
Figure 10:
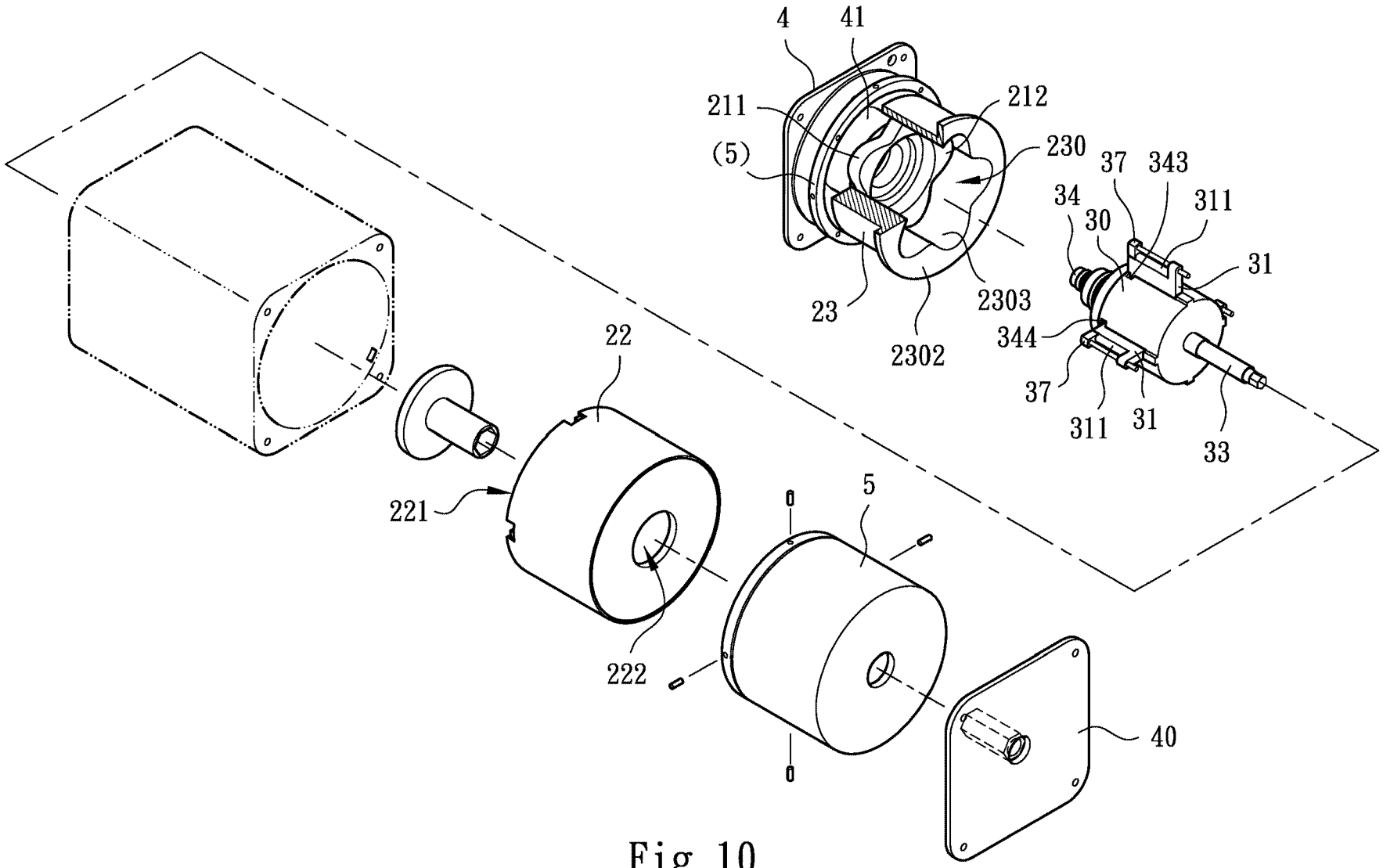
FIG. 10 is a perspective partially assembled view of the second preferred embodiment of the present invention according to FIG. 9.
Figure 12:
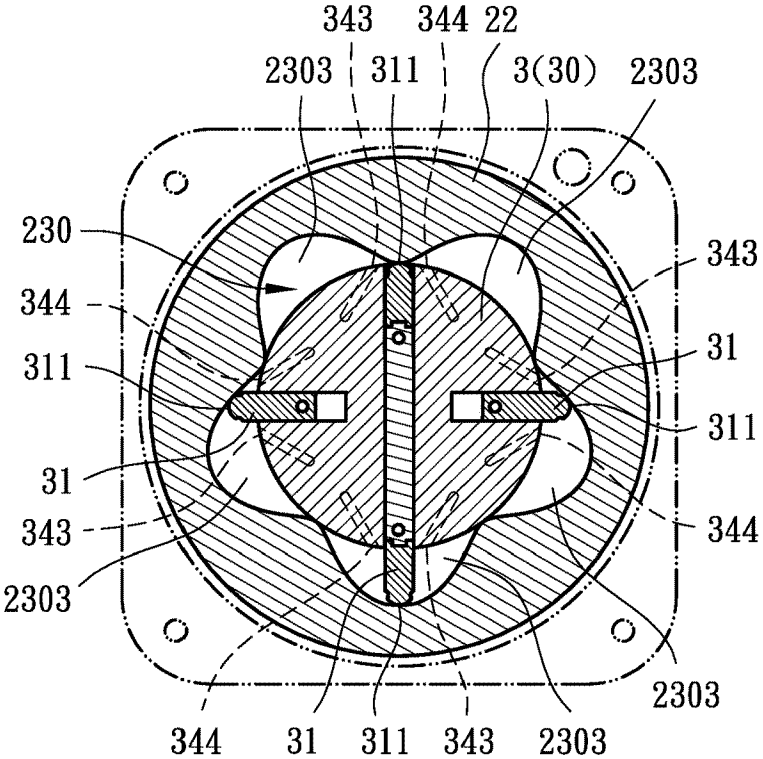
FIG. 12 is a radially sectional assembled view of the second preferred embodiment of the present invention according to FIG. 11, which is taken along line A-A.

FIG. 8 shows an integrated structure of a drive device composed of two pumps connected with each other as an assembly unit. A common engagement member 6 is engaged between the two pumps to synchronously drive the two pumps. FIG. 8-1 shows an integrated structure of a drive device composed of four pumps as an assembly unit. A common engagement member 60 is engaged between the four pumps to synchronously drive the four pumps. According to the phase difference between the positions of the vanes 31 of the respective pumps in the drawings, it can be found that the suction/discharge timing between the respective pumps are just complementary to the increase/decrease of the suction/discharge amounts. Therefore, the suction/discharge amounts are equal to each other at every time point and the state is stabilized. In operation, this avoids the undulated unstable phenomenon during the driving process due to the difference between the fluid suction/discharge amounts. In addition, FIG. 8-2 shows a drive device composed of four pumps arranged in an array as an assembly unit according to FIG. 8-1. FIG. 8-2 is simply different from FIG. 8-1 in that a common engagement member 61 is positioned around the respective pumps and engaged with the pumps to drive the pumps. This achieves a similar synchronously driving effect. Moreover, FIG. 8-3 shows a linearly arranged driving mode. A common engagement member 62 is engaged between each two adjacent pumps to linearly connect the respective pumps. FIG. 8-4 shows a stringed driving mode. The respective pumps are coaxially or nearly coaxially serially connected.

Please further refer to FIGS. 9 to 12, which show a second embodiment of the present invention. The second embodiment also mainly includes a fixed wall member 21, a movable wall member 22 and a movable vane chamber sleeve 23 defining a vane chamber 230 having variable capacity with multiple eccentric vane chamber sections 2303. A vane rotor 3 with multiple vanes 31 is arranged in the vane chamber 230. The number and configuration of the vanes 31 correspond to the number and configuration of the eccentric vane chamber sections 2303. Accordingly, a pump with variable suction/discharge amount, which can provide many times of suction/discharge operations in one single operation cycle is achieved. In principle, the number of the vanes 31 should be less than or equal to the number of the eccentric vane chamber sections 2303 so as to prevent the suction passage and the discharge passage appear in the same eccentric vane chamber section 2303 at the same time and communicate with each other to deteriorate the driving performance of the pump.

Figure 13:
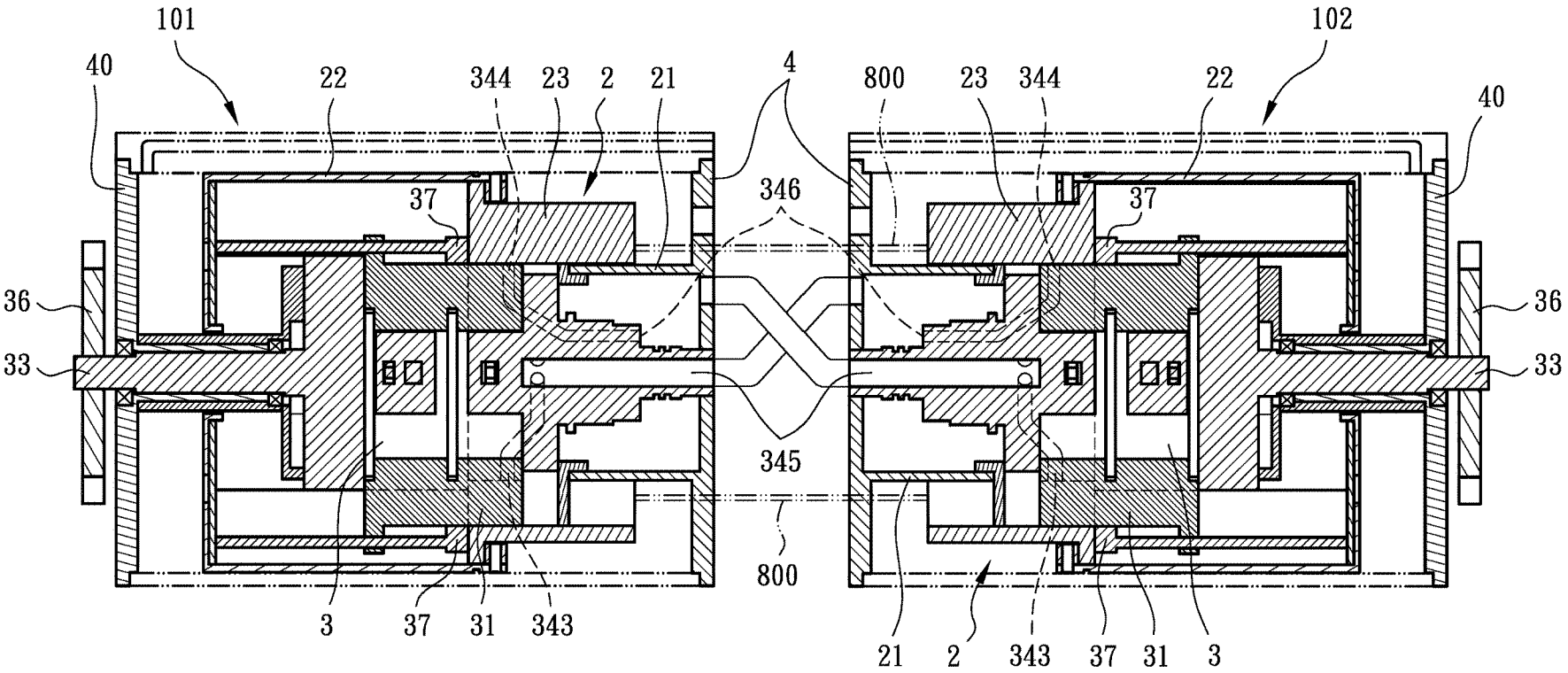
FIG. 13 is a sectional assembled view of the second preferred embodiment of the present invention according to FIG. 10, wherein a active pump is assembled with a passive pump.

The second embodiment is most obviously different from the first embodiment in that the movable vane chamber sleeve 23 of the second embodiment can only axially displace relative to the vane rotor 3, while failing to synchronously rotate with the vane rotor 3. The suction/discharge passages 343, 344 of the second embodiment can be disposed on the suction side and the discharge side of the vane 31 of the impeller 30 of the vane rotor 3 as in the first embodiment. FIG. 13 shows that the multi-vane pump with variable suction/discharge amount shown in FIGS. 9 to 12 is assembled in accordance with the assembling mode of FIG. 7, that is, the discharge passage of the active pump 101 is in communication with the suction passage of the passive pump 102, while the suction passage of the active pump 101 is in communication with the discharge passage of the passive pump 102. Accordingly, as the pump of the first embodiment, a closed loop is formed between the active pump 101 and the passive pump 102 for the active pump 101 to drive the passive pump 102. By means of the vane chamber 230 with multiple eccentric vane chamber sections 2303 and variable capacity, in operation of the closed loop, when the force difference between the driving force of the active pump 101 and the load resistance of the passive pump 102 changes, under the action of the force difference, the capacities of the eccentric vane chamber sections 2303 can be automatically modulated to a temporary balanced state after the force difference disappears. At this time, the rotational speed between the active pump 101 and the passive pump 102 is in inverse proportion to the capacity of the eccentric vane chamber sections 2303 after automatically modulated, whereby the closed loop assembly between the active pump 101 and the passive pump 102 becomes a transmission drive device capable of automatically modulating rotational speed ratio. In addition, in the second embodiment, the assembly of the active pump and the passive pump with multiple vanes 31 and multiple eccentric vane chamber sections 2303 can provide a driving force as the assembly of the multiple active pumps and the multiple passive pumps each having one single vane and one single eccentric vane chamber section as shown in FIGS. 7-1 and 7-2. Therefore, the second embodiment can provide stable driving effect and obviously has very high utility and value in industries.

According to the above design of the pump with variable suction/discharge amount of the present invention, in the condition that the original radial size is not increased, the pump with variable suction/discharge amount can truly effectively achieve the modulation function for the suction/discharge amount. The pump with variable suction/discharge amount of the present invention not only can effectively improve the shortcomings of the conventional pumps with variable suction/discharge amount, but also can be assembled to form a drive device capable of automatically modulating the rotational speed ratio between the pumps. The pump with variable suction/discharge amount of the present invention is indeed inventive and has high practical value.

The above embodiments are only used to illustrate the present invention, not intended to limit the scope thereof. Many modifications of the above embodiments can be made without departing from the spirit of the present invention.

What is claimed is:

1. A pump with variable suction/discharge amount, which is characterized in including a vane chamber body and a vane rotor; the vane chamber body internally having a vane chamber, and the vane chamber having a capacity space defined between a fixed wall member, a movable wall member and a movable vane chamber sleeve in the vane chamber body, the vane chamber being partitioned by an impeller of the vane rotor in the vane chamber into a plurality of eccentric vane chamber sections and a plurality of vanes being disposed on the impeller, and the number of the eccentric vane chamber sections being more than or equal to the number of the vanes; in the vane chamber, at any timing when the vane rotor continuously operates in the same direction relative to the vane chamber body, one of two lateral sides of each vane adjacent to another vane unchangeably being a suction side while another one of the two lateral sides of each vane adjacent to another vane unchangeably being a discharge side, and the suction side and the discharge side respectively having suction/discharge passages in communication with outer side of the pump; the fixed wall member being positioned in a fixed position in the vane chamber body; each vane having a corresponding symmetrical vane of the plurality of vanes, the angle of which is 180-degree different from the angle of the vane, whereby at any moment of the operation process; when the vane extends out of the impeller of the vane rotor, the 180-degree symmetrical vane is retracted into the impeller of the vane rotor, and when the vane is retracted into the impeller of the vane rotor, the 180-degree symmetrical vane extends out of the impeller of the vane rotor, so that the vane and the 180-degree symmetrical vane are complementary to each other; the movable wall member and the movable vane chamber sleeve being displaceable in an axial direction of the vane rotor relative to the fixed wall member to increase or decrease and change the capacity space of the vane chamber, so as to form the capacity space with variable suction/discharge amount.

2. The pump with variable suction/discharge amount as claimed in claim 1, characterized in that at least two suction/discharge passages openings are disposed on the impeller of the vane rotor between any two adjacent vanes, one of the suction/discharge passage openings being in communication with the suction side, while the other of the suction/discharge passage openings being in communication with the discharge side, and both suction/discharge passage openings being in communication with the outer side of the vane chamber.

3. The pump with variable suction/discharge amount as claimed in claim 1, characterized in that a sealing block is disposed at inter-contacting sections of the vane, the movable wall member and the movable vane chamber sleeve.

4. The pump with variable suction/discharge amount as claimed in claim 1, characterized in that the fixed wall member has a fixed wall end face, the fixed wall end face being disposed at one end of the fixed wall member, the fixed wall member being capped on a base seat of a support body, said vane rotor being formed with a rotor shaft having a first end and a second end, wherein one end of said first and second ends of the rotor shaft pass through the fixed wall member, at least one end of the first and second ends of said rotor shaft being pivotally supported on the support body, at least one end of the first and second ends of said rotor shaft outward outputting power or bearing power, the fixed wall end face being tightly attachable to an end face of the impeller of the vane rotor, the movable vane chamber sleeve being fitted on the fixed wall member around the vane rotor, the movable wall member being formed with vane receiving slots, the number of the vane receiving slots being equal to the number of the vanes, a fitting hole being formed at a center of the movable wall member, the fitting hole of the movable wall member being fitted on the impeller of the vane rotor, whereby the vanes on the impeller can slide within the vane receiving slots of the movable wall member, the movable wall member and the movable vane chamber sleeve keeping tightly attaching to each other, whereby the movable wall member and the movable vane chamber sleeve can synchronously move in the axial direction of the vane rotor to change the capacity of the vane chamber.

5. A drive device with variable suction/discharge amount composed of pumps with variable suction/discharge amount as claimed in claim 1, comprising: an active pump and a passive pump with variable suction/discharge amount oppositely coupled to one another, characterized in that said active and passive pumps with variable suction/discharge amount are connected and assembled to form the drive device with variable suction/discharge amount, wherein, during the operation process of the active pump with variable suction/discharge amount and the passive pump with variable suction/discharge amount, the sum of the capacities of the suction sides in all the eccentric vane chamber sections being equal to the sum of the capacities of the discharge sides in all the eccentric vane chamber sections.

6. A drive device with variable suction/discharge amount composed of the pumps with variable suction/discharge amount as claimed in claim 1, characterized in that at least one of the pumps with variable suction/discharge amount are connected and assembled to form the drive device with variable suction/discharge amount, and the drive device with variable suction/discharge amount internally having the plurality of vanes, the number of which being a multiple of four.

7. A drive device with variable suction/discharge amount composed of the pumps with variable suction/discharge amount as claimed in claim 1, characterized in that at least one of the pumps with variable suction/discharge amount are connected and assembled to form an active drive device with variable suction/discharge amount and at least one pumps with variable suction/discharge amount are connected and assembled to form a passive drive device with variable suction/discharge amount, and the active drive device with variable suction/discharge amount being further connected and assembled with the passive drive device with variable suction/discharge amount to form an active/passive closed loop variable speed drive device.

8. A drive device with variable suction/discharge amount composed of the pumps with variable suction/discharge amount as claimed in claim 4, characterized in that at least one of the pumps with variable suction/discharge amount are connected and assembled to form an active drive device with variable suction/discharge amount and at least one of the pumps with variable suction/discharge amount are connected and assembled to form a passive drive device with variable suction/discharge amount, the active drive device with variable suction/discharge amount being further connected and assembled with the passive drive device with variable suction/discharge amount to form an active/passive closed loop variable speed drive device.

9. The drive device as claimed in claim 7, characterized in that a displacement resistance member is additionally disposed in at least one of enlarging directions of the space of the vane chamber of the active drive device with variable suction/discharge amount and a decreasing direction of the space of the vane chamber of the passive drive device with variable suction/discharge amount.

10. A driving method employing the pumps with variable suction/discharge amount, characterized in the following steps:

in a closed loop, assembling at least one pumps with variable suction/discharge amount to form at least one drive devices with variable suction/discharge amount; the pumps with variable suction/discharge amount respectively including a vane chamber body and a vane rotor, the vane chamber body internally having a vane chamber, which has a capacity space defined between a fixed wall member, a movable wall member and a movable vane chamber sleeve in the vane chamber body the vane chamber being partitioned by an impeller of the vane rotor in the vane chamber into a plurality of eccentric vane chamber sections, a plurality of vanes being disposed on the impeller, and the number of the eccentric vane chamber sections being more than or equal to the number of the vanes; in the vane chamber, at any timing when the vane rotor continuously operates in the same direction relative to the vane chamber body, one of two lateral sides of each vanes adjacent to another vane unchangeably being a suction side while another one of the two lateral sides of each vane adjacent to another vane unchangeably being a discharge side, and the suction side and the discharge side respectively having communicable suction/discharge passages in communication with outer side of the pump; the fixed wall member being positioned in a fixed position in the vane chamber body; and the movable wall member and the movable vane chamber sleeve are displaceable in an axial direction of the vane rotor relative to the fixed wall member to increase or decrease and change the capacity space of the vane chamber, so as to form a pump capacity space with variable suction/discharge amount, inputting a fluid into the vane chamber of each drive device with variable suction/discharge amount, the input fluid pushing against one side of one of the plurality of vanes in the vane chamber to drive the vane rotor to rotate, at the same time, the fluid in the vane chamber at the other side of the vane being pushed by the vane out of the vane chamber to form a driving loop;

synchronously displacing the movable wall member and the movable vane chamber sleeve of the pump in each drive device with variable suction/discharge amount in the axial direction of the vane rotor relative to the fixed wall member so as to change the capacity space of each vane chamber of the drive device with variable suction/discharge amount, such that amounts of the fluid being pushed out of and sucked into the vane chamber change each time the vane rotor in the vane chamber rotates by one circle; inputting and outputting the same amount of fluid per unit time into and from each drive device with variable suction/discharge amount, such that the rotational speed of the vane rotor decreases when the capacity space of the vane chamber is increased, and that the rotational speed of the vane rotor increases when the capacity space of the vane chamber is decreased; that is, the vane rotor of each having a rotational speed in inverse proportion to the change in the capacity space of the vane chamber.

11. The driving method as claimed in claim 10, characterized in that a drive device of the at least one drive devices with variable suction/discharge amount is set an active drive device with variable suction/discharge amount and another drive device with variable suction/discharge amount is set a passive drive device with variable suction/discharge amount, the active drive device with variable suction/discharge amount and the passive drive device with variable suction/discharge amount being assembled to form a closed driving loop, the amount of the fluid in the closed loop being constant and unchanged, whereby when the capacity of the vane chamber of the active drive device with variable suction/discharge amount is enlarged, the capacity of the vane chamber of the passive drive device with variable suction/discharge amount is reversely minified, in the condition that a constant amount of fluid flows within the closed loop per unit time, the rotational speed of the vane rotor of the active drive device with variable suction/discharge amount being slowed down, while the rotational speed of the vane rotor of the passive drive device with variable suction/discharge amount being increased, the rotational speed of the vane rotor of the active drive device with variable suction/discharge amount being in inverse proportion to the rotational speed of the vane rotor of the passive drive device with variable suction/discharge amount, reversely, when the capacity of the vane chamber of the active drive device with variable suction/discharge amount is decreased, the capacity of the vane chamber of the passive drive device with variable suction/discharge amount being enlarged, in the condition that a constant amount of fluid flows within the closed loop per unit time, the rotational speed of the vane rotor of the active drive device with variable suction/discharge amount being increased, while the rotational speed of the vane rotor of the passive drive device with variable suction/discharge amount being slowed down, the rotational speed of the vane rotor of the active drive device with variable suction/discharge amount being also in inverse proportion to the rotational speed of the vane rotor of the passive drive device with variable suction/discharge amount.

12. The driving method as claimed in claim 11, characterized in that at least one of the movable wall member and the movable vane chamber sleeve in the active drive device with variable suction/discharge amount and the passive drive device with variable suction/discharge amount is forcedly pushed by an external force to make the movable wall member and the movable vane chamber sleeve of the active drive device with variable suction/discharge amount and the passive drive device with variable suction/discharge amount synchronously displace in the axial direction of the vane rotor, the synchronous displacement distance of the movable wall member and the movable vane chamber sleeve of the active drive device with variable suction/discharge amount being equal to the synchronous displacement distance of the movable wall member and the movable vane chamber sleeve of the passive drive device with variable suction/discharge amount.

13. The driving method as claimed in claim 11, characterized in that due to that the amount of the fluid in the closed loop being constant and unchanged, the capacity of the vane chamber of the active drive device with variable suction/discharge amount and the capacity of the vane chamber of the passive drive device with variable suction/discharge amount are synchronously changed and increased/decreased in a complementary relationship, that is, when the movable wall member and the movable vane chamber sleeve of the active drive device with variable suction/discharge amount synchronously displace in the axial direction of the vane rotor toward the fixed wall member to minify the capacity of the vane chamber, the movable wall member and the movable vane chamber sleeve of the passive drive device with variable suction/discharge amount synchronously displace in the axial direction of the vane rotor away from the fixed wall member to enlarge the capacity of the vane chamber, the displacement distance of the movable wall member and the movable vane chamber sleeve of the active drive device with variable suction/discharge amount being equal to the displacement distance of the movable wall member and the movable vane chamber sleeve of the passive drive device with variable suction/discharge amount, reversely, when the movable wall member and the movable vane chamber sleeve of the active drive device with variable suction/discharge amount synchronously displace in the axial direction of the vane rotor away from the fixed wall member to enlarge the capacity of the vane chamber, the movable wall member and the movable vane chamber sleeve of the passive drive device with variable suction/discharge amount synchronously displacing in the axial direction of the vane rotor toward the fixed wall member to minify the capacity of the vane chamber, the displacement distance of the movable wall member and the movable vane chamber sleeve of the active drive device with variable suction/discharge amount being equal to the displacement distance of the movable wall member and the movable vane chamber sleeve of the passive drive device with variable suction/discharge amount.

14. A driving method for variable speed drive device, the variable speed drive device including at least one pumps with variable suction/discharge amount assembled to form an active drive device with variable suction/discharge amount, and at least one pumps with variable suction/discharge amount assembled to form a passive drive device with variable suction/discharge amount, and the active and the passive drive device with variable suction/discharge amount are then connected to together form an active and passive closed loop variable speed drive device; the pumps with variable suction/discharge amount respectively including a vane chamber body and a vane rotor, the vane chamber body internally having a vane chamber, which has a capacity space defined between a fixed wall member, a movable wall member and a movable vane chamber sleeve in the vane chamber body; the vane chamber being partitioned by an impeller of the vane rotor in the vane chamber into a plurality of eccentric vane chamber sections, a plurality of vanes being disposed on the impeller, and the number of the eccentric vane chamber sections being more than or equal to the number of the vanes; in the vane chamber, at any timing when the vane rotor continuously operates in the direction relative to the vane chamber body, one of two lateral sides of each vanes adjacent to another vane unchangeably being a suction side, while another one of the two lateral sides of each vane adjacent to another vane unchangeably being a discharge side, and the suction side and the discharge side respectively communicable suction discharge passages in communication with outer side of the pump; the fixed wall member being positioned in a fixed position in the vane chamber body; and the movable wall member and the movable vane chamber sleeve being displaceable in an axial direction of the vane rotor relative to the fixed wall member to increase or decrease and change the capacity space of the vane chamber, so as to form a pump capacity space with variable suction/discharge amount; the driving method being characterized in including the following steps:

(1) causing the variable speed drive device to operate and allowing a difference value between a driving force of the active drive device with variable suction/discharge amount and a load resistance born by the passive drive device with variable suction/discharge amount;

(2) as an effect of the difference value between the driving force and the load resistance, the movable wall members and the movable vane chamber sleeves of the active and the passive drive device with variable suction/discharge amount being subjected to a compressive push and a vacuum suction produced in the vane chamber, and accordingly being displace synchronously, causing the capacity space of the vane chamber of the active and the passive drive device with variable suction/discharge amount to change and adjust their volume automatically under the effect of the difference value between the driving force and the load resistance; and (3) in the closed loop, when a balance of force is reached, the capacity spaces of the vane chambers of the active drive device and the passive drive device with variable suction/discharge amount being eventually automatically adjusted to a state in which the driving force of the active drive device with variable suction/discharge amount is equal to the load resistance of the passive drive device with variable suction/discharge amount, meanwhile, the volumes of the capacity spaces of the vane chambers and the rotational speed of the active and the passive drive device with variable suction/discharge amount also being automatically adjusted to be inversely proportional to each other during pump operation.

* * * * *